US006301451B1

(12) United States Patent
Ando et al.

(10) Patent No.: US 6,301,451 B1
(45) Date of Patent: Oct. 9, 2001

(54) IMAGE FORMING APPARATUS WITH PAPER TRANSPORT SYSTEM TIMING CONTROL

(75) Inventors: Ryo Ando; Toshiyuki Kazama; Hirotaka Mori, all of Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/505,692

(22) Filed: Feb. 18, 2000

(30) Foreign Application Priority Data

Feb. 19, 1999 (JP) ..... 11-041690

(51) Int. Cl.[7] ..... G03G 15/00; G03G 15/01
(52) U.S. Cl. ..... 399/38; 399/301
(58) Field of Search ..... 399/162, 163, 399/165, 301, 38

(56) References Cited

U.S. PATENT DOCUMENTS 5,875,380 * 2/1999 Iwata et al. ..... 399/301

FOREIGN PATENT DOCUMENTS

B2-6-93145 11/1994 (JP) .
A-11-194561 7/1999 (JP) .

* cited by examiner

*Primary Examiner*—Fred L Braun
(74) *Attorney, Agent, or Firm*—Oliff & Berridge, P.L.C.

(57) ABSTRACT

An image forming apparatus capable of matching, with high precision, the timing of the paper arriving at the transfer position and the timing of the toner image arriving there and not requiring the detection of the front end position of the toner image as by a sensor for the matching of the timings. The image forming apparatus has an image forming unit to make an image on image carriers, a transfer unit to transfer the image on the image carriers onto the paper, a transporting unit to transport the paper toward the transfer unit, a calculation unit to calculate a time when the image on the image carriers will arrive at the image transfer position or nearby position and correct the calculated result according to a predetermined parameter, and a control unit to control the paper transporting operation of the transporting unit according to the time determined by the calculation unit.

21 Claims, 13 Drawing Sheets

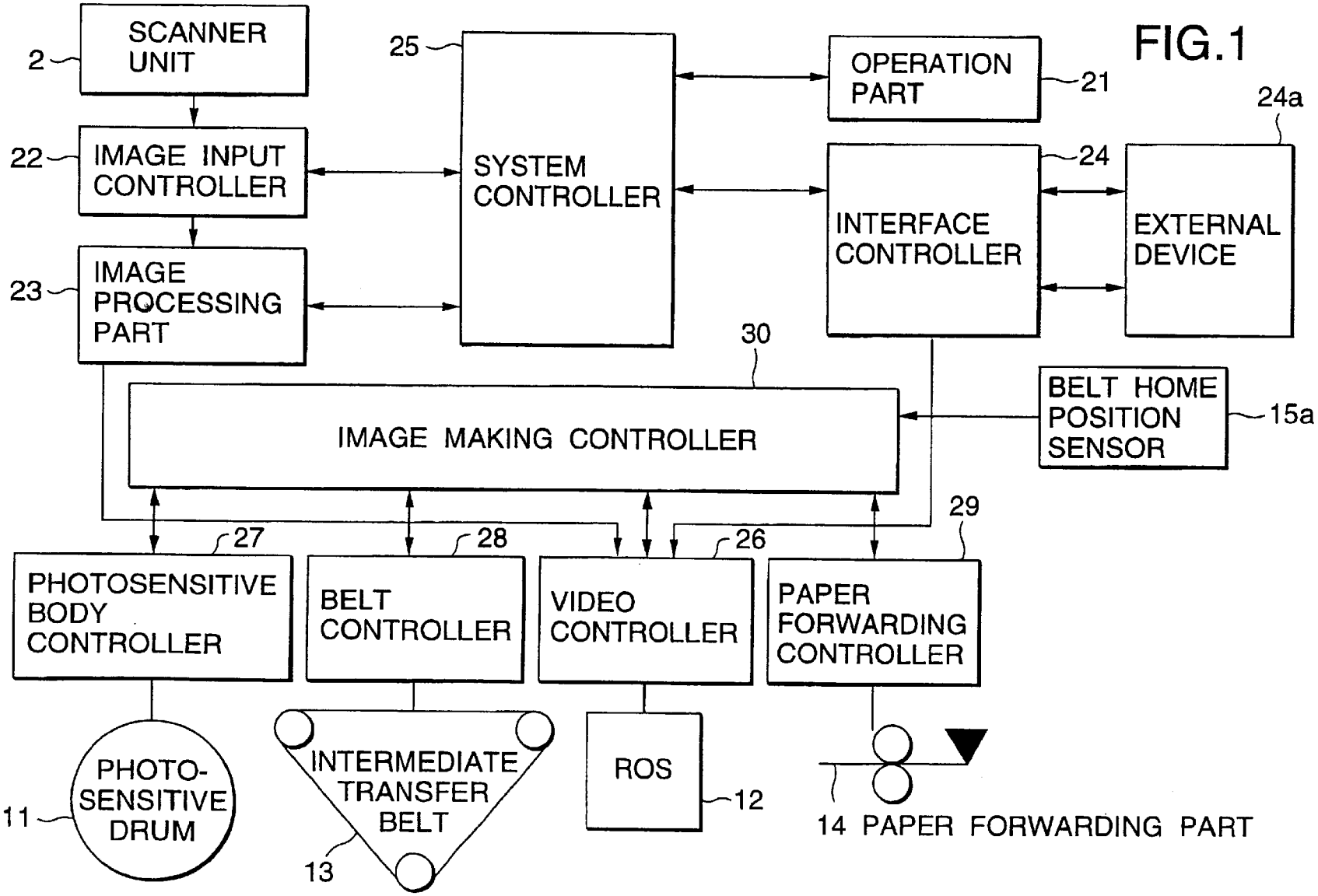
FIG.1
24a
EXTERNAL DEVICE
15a
BELT HOME POSITION SENSOR
21
OPERATION PART
24
INTERFACE CONTROLLER
29
PAPER FORWARDING CONTROLLER
14 PAPER FORWARDING PART
30
IMAGE MAKING CONTROLLER
26
VIDEO CONTROLLER
12
ROS
25
SYSTEM CONTROLLER
28
BELT CONTROLLER
INTERMEDIATE TRANSFER BELT
13
27
PHOTOSENSITIVE BODY CONTROLLER
PHOTO-SENSITIVE DRUM
11
2
SCANNER UNIT
22
IMAGE INPUT CONTROLLER
23
IMAGE PROCESSING PART

WHEN PAPER ENGAGEMENT IS NOT SUFFICIENT
A

WHEN PAPER ENGAGEMENT IS SUFFICIENT
PAPER TRANSPORTING VARIATION IN SUB-SCAN DIRECTION DUE TO PAPER ENGAGEMENT VARIATION

IMAGE FORMING APPARATUS WITH PAPER TRANSPORT SYSTEM TIMING CONTROL

BACKGROUND OF THE INVENTION

1. Technical Field

The present invention relates to an image forming apparatus which uses an electrophotographic method to form an image on paper and output it, like copying machines and printers.

2. Description of the Prior Art

An image forming apparatus using the electrophotographic method generally forms an image on paper by forming an electrostatic latent image corresponding to an image signal on a photosensitive body, developing the latent image into a toner image, transferring the toner image onto the paper, and fusing the toner image on the paper.

In such an image forming apparatus, sheets of paper stacked on a paper tray are usually picked up one by one and transported toward a toner image transfer position. During the paper transporting process, any difference between the timing at which the paper reaches the image transfer position and the timing at which the toner image reaches there will result in a shift of the toner image position on the paper from the desired position. When an image is formed over an entire surface of the paper, for example, edge dimensions become uneven, thus significantly degrading the appearance of the formed image.

For this reason, some image forming apparatuses incorporate into the paper transporting system a mechanism for adjusting the timing of the paper reaching the image transfer position. For example, there is a construction in which, as shown in FIG. 19, two paper transporting rollers A, B are arranged along the paper transporting direction of the paper P. In this construction, the paper P fed by the paper transporting roller B on the upstream side is struck against the paper transporting roller A on the downstream side which is at rest and then the timing at which to start rotating the paper transporting roller A is adjusted to match the timing at which the paper arrives at the transfer position to the toner image arrival timing.

In the conventional image forming apparatus described above, however, as shown in FIGS. 20A and 20B the way the paper engages the paper transporting roller A at rest may vary depending on the curled state of the lead edge of the paper, causing the paper position relative to the paper transporting roller A to change from one sheet of paper to another, as shown in FIGS. 21A and 21B. This may result in a difference in the transfer position arrival timing between the paper and the toner image.

To deal with this problem, a so-called nonstop servo registration control may be adopted which temporarily stops the paper in front of the paper transporting roller A and rotates the paper transporting roller A as the lead edge of the paper reaches the paper transporting roller A. This will eliminate possible variations in the paper engagement condition and thereby improves the precision of the paper position relative to the paper transporting roller A.

In this case, while the precision of the timing of the paper arriving at the transfer position improves, variations in the toner image arrival timing become a serious problem. That is, when variations in the toner image arrival timing occur due to the manufacturing precision and assembly errors of components of the image forming apparatus or their changes with elapse of time, it becomes difficult to match the paper arrival timing with the toner image arrival timing, even with an improved precision of the timing of the paper arriving at the transfer position. Especially in an image forming apparatus that uses an image carrying belt, such as a photosensitive belt and an intermediate transfer belt, variations in the toner image arrival timing increase because the image carrying belt elongates or contracts in response to changes in temperature, humidity or belt tension.

Therefore, as shown in FIG. 22A or 22B, when the nonstop servo registration control is adopted, the amount of variation in the toner image arrival timing needs to be determined by detecting the position of the front end of the toner image on an image carrier 41, such as a photosensitive drum or an intermediate transfer belt, by an image front end reading sensor 42 provided near the toner image transfer position. That is, for the image front end reading sensor 42 to detect the front end position of the toner image, it is necessary to form a toner patch on the image carrier 41 for reading the timing, or form a predetermined marking (such as a notch) on the image carrier 41.

The formation of the toner patch on the image carrier 41 in turn requires a pattern generator, control, cleaning, and others, leading to an increase in the apparatus cost and in the development man-hours. Further, if the image front end reading sensor 42 is of a general type, because its reading sensitivity characteristic depends on the color of the toner patch or marking, a satisfactory reading sensitivity characteristic may not be obtained when a single color image (toner patch) is formed. Another problem is that when a marking is formed on the image carrier 41 in advance, the pitch of the marking cannot be changed, thus greatly lowering the productivity of image forming.

The image front end reading sensor 42 is arranged close to the image carrier 41 in order to be able to read the toner patch or marking on the image carrier 41. This renders the toner on the image carrier 41 more likely to be scattered and the scattered toner may contaminate the marking, resulting in a degraded detection precision or even a failure to detect.

SUMMARY OF THE INVENTION

The present invention provides an image forming apparatus which can match, with high precision, the timing of the paper arriving at the transfer position with the timing of the toner image arriving there, without being influenced by positional misregistrations of paper in the paper transporting direction or variations in the timing of the toner image arriving at the transfer position, and does not require detection by a sensor of a front end position of the toner image.

According to an aspect of the present invention, the image forming apparatus has an image forming unit to make an image on an image carrier, a transfer unit to transfer the image formed on the image carrier by the image forming unit onto paper, a transporting unit to transport the paper toward an image transfer position of the transfer unit, a calculation unit to calculate a time when the image on the image carrier will arrive at the image transfer position or nearby position and correct the calculated result according to a predetermined parameter, and a control unit to control the paper transporting operation of the transporting unit according to the time determined by the calculation unit.

In the image forming apparatus of the above configuration, when the image forming unit forms an image on the image carrier, the calculation unit calculates a point in time at which the image will arrive at the image transfer position of the transfer unit or a nearby position. The calculation unit corrects the calculated result as required according to predetermined parameters, such as an elongation or contraction of the image carrying surface of the image carrier, precisions of constitutional parts of the image forming apparatus and parts mounting errors. Based on the time determined by the calculation unit, the control unit controls the paper transporting operation of the transporting unit by adjusting the speed and timing of transportation of the paper by the transporting unit. As a result, the timing of the image arriving at the image transfer position of the transfer unit and the timing of the paper arriving there are made to coincide with each other, without detecting a variation of the image arrival timing by a sensor.

BRIEF DESCRIPTION OF THE DRAWINGS

Preferred embodiments of the present invention will be described in detail based on the following figures, wherein:

FIG. 1 is a block diagram showing a functional configuration of an entire digital composite machine employing the present invention;

FIG. 20A represents a state in which the paper end is not sufficiently engaged; and FIG. 20B represents a state in which the paper end is sufficiently engaged;

FIG. 21A represents a state in which the paper end is not sufficiently engaged; and FIG. 21B represents a state in which the paper end is sufficiently engaged; FIG. 22A represents an example configuration by a direct transfer system; and FIG. 22B represents an example configuration by intermediate transfer body system.

DESCRIPTION OF THE PREFERRED EMBODIMENTS OF THE INVENTION

The image forming apparatus according to this invention will be described by referring to the accompanying drawings.

(First Embodiment)

Here, an image forming apparatus according to the present invention applied to a digital composite machine with a copying function and a printer function will be explained.

Figure 2:
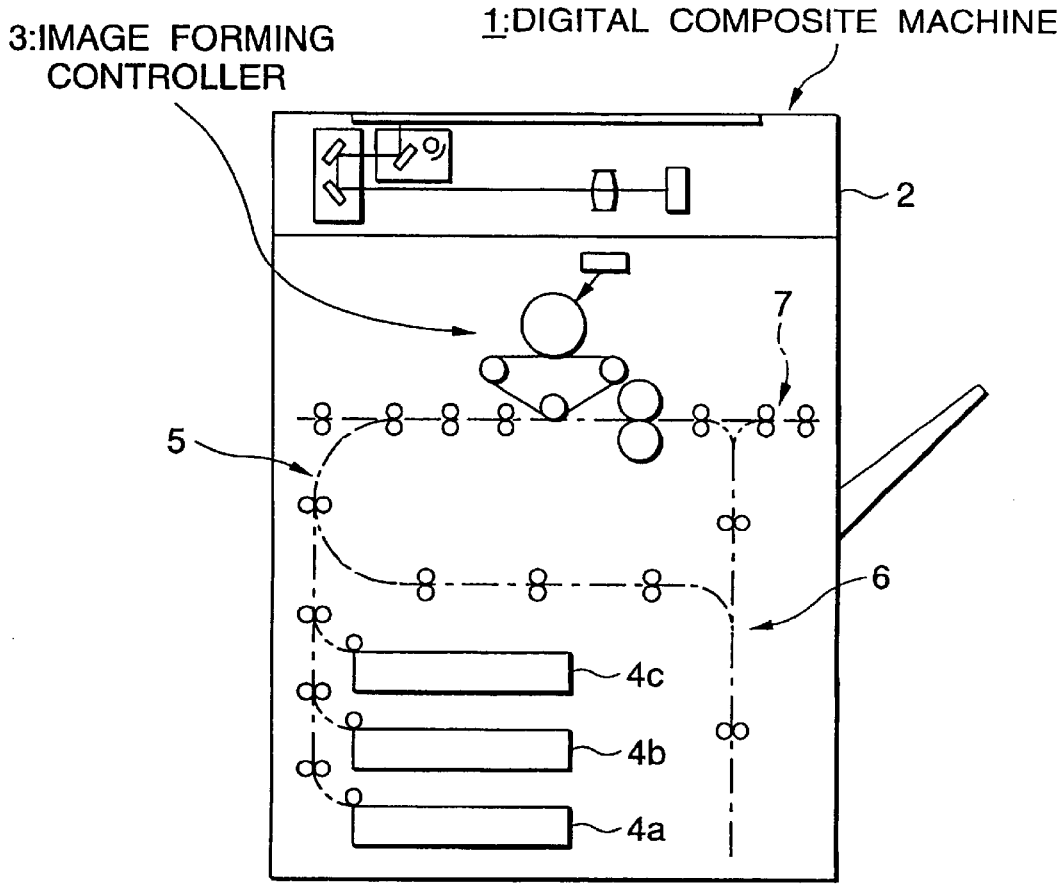
FIG. 2 is an explanatory view showing an outline configuration of the entire digital composite machine employing the present invention.
Figure 3:
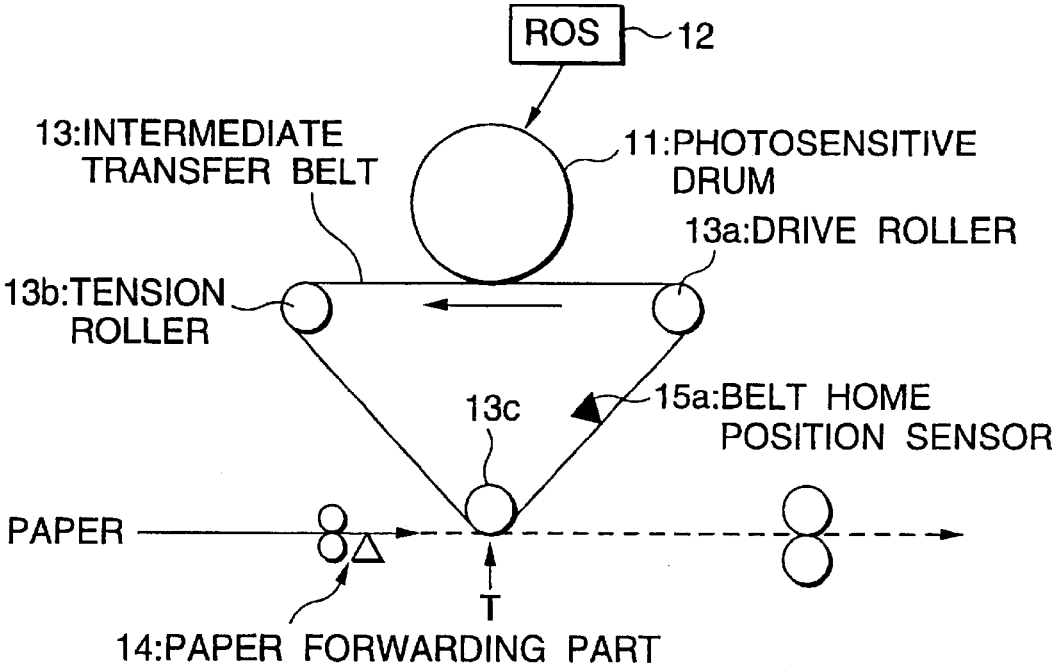
FIG. 3 is an explanatory view showing an example configuration of an image forming part in the image forming apparatus of the present invention.

FIG. 1 is a block diagram showing a functional configuration of an entire digital composite machine employing the invention. FIG. 2 is an explanatory view showing an outline configuration of the entire digital composite machine. FIG. 3 is an explanatory view showing an example configuration of a main portion of the machine.

First, the outline configuration of the whole digital composite machine of this embodiment will be described.

As shown in FIG. 2, the digital composite machine 1 of this embodiment includes a scanner 2 that optically reads image data from an original being scanned, an image forming part 3 which forms an image based on the image data obtained by the scanner 2 or image data obtained from the outside, paper trays 4*a*–4*c* individually accommodating stacks of paper of different sizes, a paper transporting part 5 that transports the paper fed from the paper trays 4*a*–4*c* to the image forming part 3, a paper reversing part 6 that turns over as required the paper on which an image has been formed by the image forming part 3 and then makes the paper transporting part 5 transport it again, and a paper discharge part 7 which discharges paper that has undergone the image forming process.

In forming an image on paper, the digital composite machine 1 with the above configuration performs the following operation. When a sheet of paper of a size manually or automatically selected is supplied from one of the paper trays 4*a*–4*c*, the paper transporting part 5 transports the paper toward the image forming part 3. When the paper arrives at the image forming part 3, an image is formed on one of the surfaces of the paper by the image forming part 3, as detailed later. Then, in a simplex copying/printing mode the paper on which an image has been formed is sent to the paper discharge part 7, from which it is discharged out of the machine. In a duplex copying/printing mode, the paper on which an image has been formed is sent to the paper reversing part 6 where it is turned over, and after that, the same image forming process is performed on the other surface.

The image forming part 3 that forms an image on the paper will be explained in more detail. The image forming part taken as an example here is of a so-called intermediate transfer type having an intermediate transfer belt and of a so-called single engine type having a single photosensitive drum.

As shown in FIG. 3, the image forming part 3 has a photosensitive drum 11 that functions as an image carrier, a raster output scanner (ROS) 12 that writes a latent image on the photosensitive drum 11, a developing device (not shown) that develops the latent image on the photosensitive drum 11 into a toner image, an intermediate transfer belt 13 like an endless belt that functions as an image carrier like the photosensitive drum 11, a transfer device (not shown) for transferring the toner image from the intermediate transfer belt 13 onto the paper, a paper forwarding part 14 that forwards the paper supplied from the paper transporting part 5 toward the transfer device, and a fixing device (not shown) that fixes the toner image on the paper to which it was transferred by the transfer device.

The intermediate transfer belt 13 is tensed by three rollers: a drive roller 13*a* rotated by a drive source not shown, a tension roller 13*b* that gives tension to the intermediate transfer belt 13, and a transfer roller 13*c* installed at an image transfer position T of the transfer device. The intermediate transfer belt 13 also has a belt home position sensor 15*a* arranged along the intermediate transfer belt 13 which detects a reference point (home position) provided beforehand on the intermediate transfer belt 13.

The image forming part 3 with the above configuration performs the following operation. When the ROS 12 writes a latent image on the photosensitive drum 11 according to the image data obtained from the scanner 2 or the image data obtained from the outside, the developing device develops the latent image into a toner image. The developed toner image is transferred from the photosensitive drum 11 onto the intermediate transfer belt 13. When an image to be formed is a color image, each time the intermediate transfer belt 13 makes one rotation, the toner images of four colors, yellow (Y), magenta (M), cyan (C) and black (K), are successively transferred, one color image at a time, onto the intermediate transfer belt 13 according to the detection result of the belt home position sensor 15*a* to overlay the four color toner images on the intermediate transfer belt 13. Then, the paper forwarding part 14 forwards the paper toward the image transfer position T in the transfer device, where the synthesized color toner image is transferred from the intermediate transfer belt 13 onto the paper. The paper with the toner image is now carried to the fixing device where the toner image is fixed by the action of heat and pressure. In this way the image forming part 3 forms an image on the paper.

Next, an overall configuration of electrical function of the above digital composite machine 1 will be explained.

In addition to the scanner 2, the photosensitive drum 11, the ROS 12, the intermediate transfer belt 13, the belt home position sensor 15*a* and the paper forwarding part 14. The digital composite machine 1 as shown in FIG. 1 has the following components: an operation part 21 to be manipulated by a user, an image input controller 22 for controlling the operation of the scanner 2, an image processing part 23 for processing image data obtained from the scanner 2, an interface controller 24 that interfaces with an external device 24*a* such as a personal computer to control communication with the external device 24*a* (e.g., transmission and reception of image data), a system controller 25 for controlling the overall operation of the digital composite machine 1 (e.g., job management), a video controller 26 for controlling the latent image writing operation (e.g., write start timing) in the ROS 12, a photosensitive body controller 27 for controlling the rotation (e.g., rotation speed) of the photosensitive drum 11, a belt controller 28 for controlling the rotation (e.g., rotation speed) of the intermediate transfer belt 13, a paper forwarding controller 29 for controlling the paper forwarding (e.g., paper forwarding speed and paper forwarding timing) at the paper forwarding part 14, and an image forming controller 30 for controlling image forming processing described later.

Here, the image forming processing control performed by the image forming controller 30, a feature of the digital composite machine 1 of this embodiment, will be explained in detail.

The image forming controller 30 controls the image forming processing of the image forming part 3 to prevent a discrepancy from occurring between the timing of the paper arriving at the image transfer position T and the timing of the toner image arriving there. More specifically, the following control is performed.

Figure 22A:
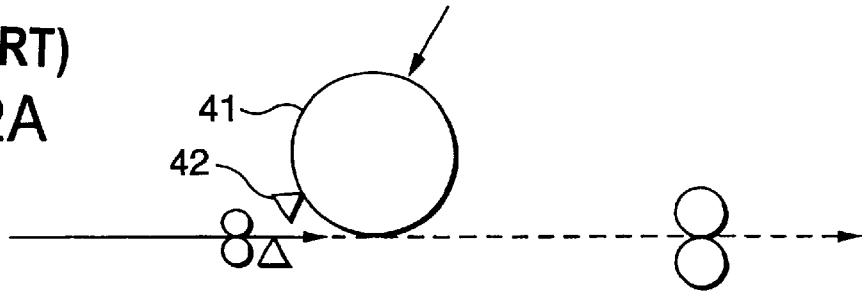
(PRIOR ART) FIG.22A
FIGS. 22A and 22B are explanatory views showing example configurations of a conventional image forming part.
Figure 22B:
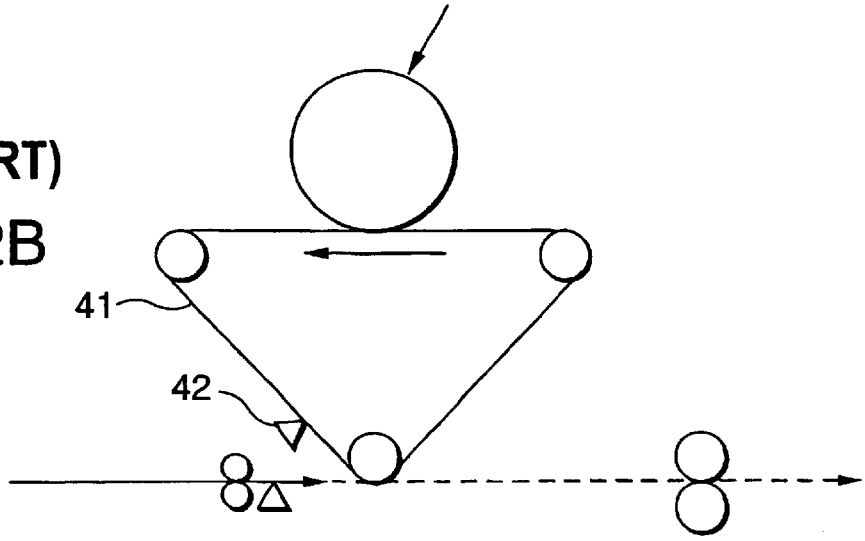
(PRIOR ART) FIG.22B

In the image forming processing of the image forming part 3, the image forming controller 30 first calculates a time at which the front end of the toner image on the intermediate transfer belt 13 will reach a predetermined point. This predetermined point may be an image transfer position T or a nearby position. Here we discuss an example case where the predetermined point is close to and in front of the image transfer position T (for example, a position where the conventional image front end reading sensor 42 is installed; see FIGS. 22A and 22B).

After it has determined the time at which the front end of the toner image will reach the predetermined point in front of the image transfer position T (hereinafter referred to as A "before-transfer point"), the image forming controller 30 generates a simulated timing signal when the front end of the toner image is considered to have just arrived at the before-transfer point. Based on the simulated timing signal the paper forwarding controller 29 controls the paper forwarding operation performed by the paper forwarding part 14.

That is, the image forming controller 30, rather than directly detecting that the front end of the toner image on the intermediate transfer belt 13 has reached the before-transfer point by detecting the toner image with a sensor, electrically creates a simulated timing signal corresponding to the time at which the front end of the toner image is considered to have just arrived at the before-transfer point in order to notify the paper forwarding controller 29 that the toner image has reached the before-transfer point.

For that purpose, the image forming controller 30 has a counter to generate a simulated timing signal.

Figure 4:
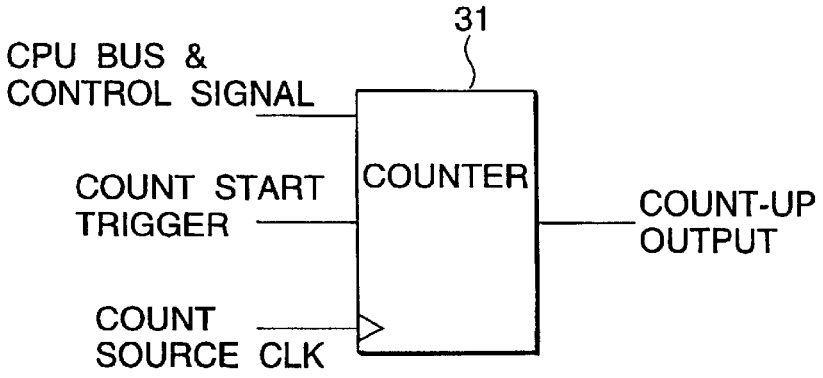
FIG. 4 is an explanatory view showing an example outline of a counter in an image forming controller.

FIG. 4 illustrates the outline of the counter used in the image forming controller.

As shown in the figure, the counter 31 operates in synchronization with a predetermined clock signal (referred to as a "count source CLK") and is started by a reference trigger signal (referred to as a "count start trigger"). When the count value of the counter reaches a specified value (referred to as a "count-up register set value") which is set by CPU (central processing unit) in the image forming controller 30 through the CPU bus, the counter outputs a simulated timing signal as count-up output.

The operation of the counter 31 is detailed as follows.

Figure 5:
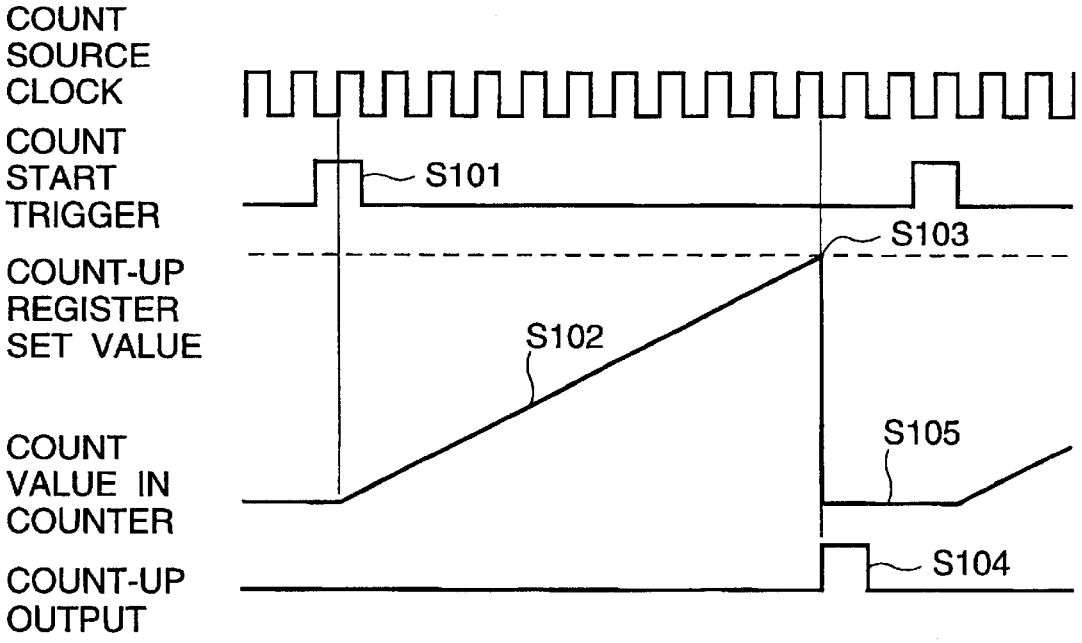
FIG. 5 is a timing chart showing an example count operation performed by the counter of FIG. 4.

FIG. 5 is a timing chart showing an example count operation by the counter.

As shown in the figure, the counter 31, when it receives the count start trigger (step 101 or abbreviated S101), starts counting and continues counting up in synchronization with the count source CLK (S102). When the count value reaches the count-up register set value (S103), the counter produces a simulated timing signal (S104) as count-up output and resets the count value in the counter (S105).

The count source CLK may be a line sync signal, a reference clock or encoder clock of the photosensitive drum 11, or a reference clock or encoder clock of the intermediate transfer belt 13. The count start trigger may use a latent image write start timing signal of the ROS 12.

The count-up register set value corresponds to the time from the moment the ROS 12 starts writing the latent image on the photosensitive drum 11 to the moment the toner image developed from the latent image is transferred to the intermediate transfer belt 13 and reaches the before-transfer point. By setting the count-up register set value as described above, the counter 31 outputs a simulated timing signal when the front end of the toner image on the intermediate transfer belt 13 is considered to have just arrived at the before-transfer point.

The CPU in the image forming controller 30 sets the count-up register set value for the register in the counter 31 before the counter 31 starts counting. The count-up register set value may be determined from the rotation speed of the photosensitive drum 11 and the moving speed of the intermediate transfer belt 13.

In the image forming part 3, the intermediate transfer belt 13 may elongate or contract due to changes in temperature, humidity or belt tension. That is, the toner image carrying surface of the intermediate transfer belt 13 may elongate or contract with elapse of time.

Thus, to prevent a discrepancy from occurring between the timing of the paper arriving at the image transfer position T and the timing of the toner image arriving there even when the intermediate transfer belt 13 elongates or contracts, the image forming controller 30 corrects, according to the elongation and contraction of the intermediate transfer belt 13, the time at which the front end of the toner image on the intermediate transfer belt 13 will arrive at the before-transfer point.

The elongation and contraction of the intermediate transfer belt 13 can be detected from its rotation cycle. Here, how the elongation and contraction of the intermediate transfer belt 13 is detected is explained.

Figure 6:
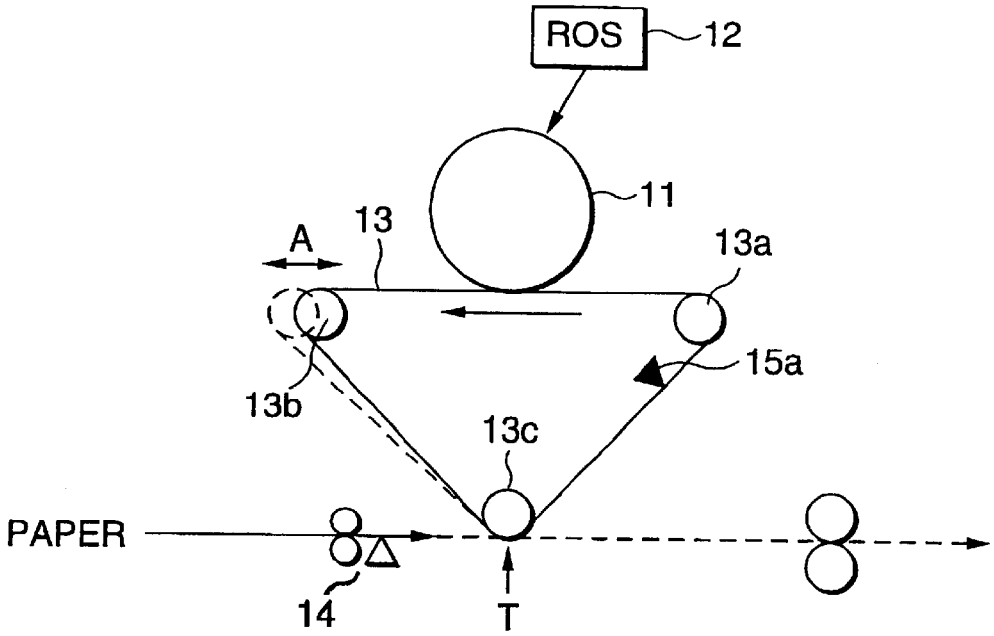
FIG. 6 is an explanatory view showing an example of how an intermediate transfer belt is elongated and contracted.
Figure 7:
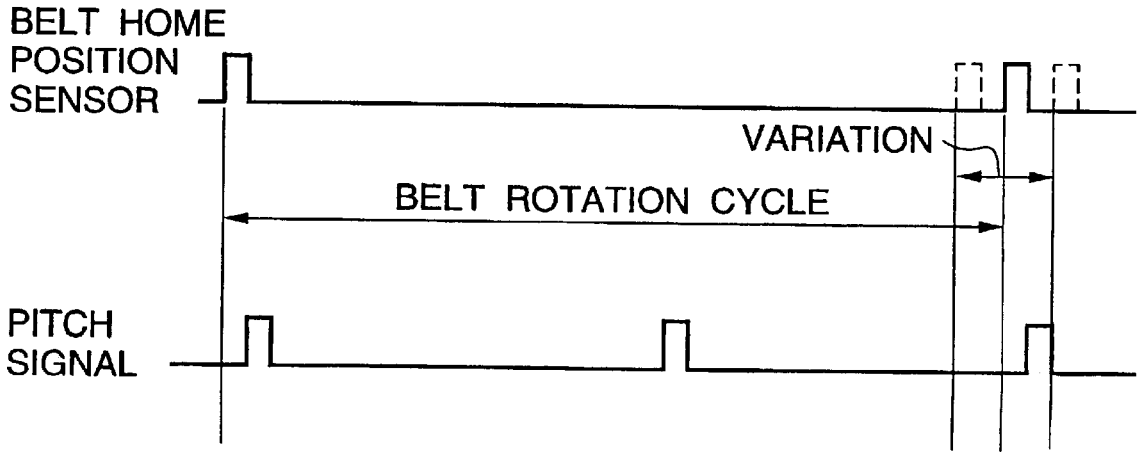
FIG. 7 is a timing chart showing an example outline of a control for even allocation of an image according to the elongation and contraction of the intermediate transfer belt.

FIG. 6 illustrates an example of how the intermediate transfer belt is elongated or contracted. FIG. 7 is a timing chart showing the outline of a control for evenly allocating an image according to the elongation or contraction of an intermediate transfer belt.

As shown in FIG. 6, when the circumferential length of the intermediate transfer belt 13 changes due to environmental influences for example (see arrow A in the figure), the position on the intermediate transfer belt 13 where the toner image is formed is offset, therefore, it is impossible to allocate the toner image evenly, which in turn gives rise to a problem that the toner image may be placed on a joint of the intermediate transfer belt 13. To solve this problem, the image forming controller 30 usually performs a pitch control to allocate the toner image evenly by taking the home position of the intermediate transfer belt 13 detect by the belt home position sensor 15*a* as a reference.

More specifically, the image forming controller 30 measures the rotation cycle of the intermediate transfer belt 13 based on the result of detection by the belt home position sensor 15*a* and outputs a pitch signal according to the measured rotation cycle, as shown in FIG. 7, to evenly allocate the toner image to be formed on the intermediate transfer belt 13. Although in the example shown the toner image is divided by two pitches, it should be noted that the same principle can be applied to other cases with greater or smaller number of pitch divisions.

From the variation in the rotation cycle of the intermediate transfer belt 13 detected during the pitch control, the image forming controller 30 calculates a deviation in time between the timing at which the ROS 12 starts writing a latent image and the moment the toner image reaches the before-transfer point. That is, the image forming controller 30 detects the elongation or contraction of the intermediate transfer belt 13 based on the variation in the rotation cycle of the intermediate transfer belt 13 and, from the result of this detection, determines an amount of deviation from the count-up register set value. The calculation of this deviation may use a function or table value set in the image forming controller 30 in advance.

After it has determined the amount of deviation from the count-up register set value according to the result of detection of elongation and contraction of the intermediate transfer belt 13, the CPU in the image forming controller 30 sets in a register of the counter 31 a new count-up register set value including the deviation. This causes the counter 31 to change the time from the input of the count start trigger to the output of the simulated timing signal.

That is, the counter 31 corrects the output timing of the simulated timing signal with a precision of one clock of the count source CLK by changing the count-up register set value. With this correction, the image forming controller 30 can now correct the calculated result of the time at which the front end of the toner image on the intermediate transfer belt 13 reaches the predetermined point.

In this way, even when the intermediate transfer belt 13 is elongated or contracted, the image forming controller 30 reflects the degree of the elongation or contraction of the belt and causes the counter 31 to generate the simulated timing signal when the front end of the toner image on the intermediate transfer belt 13 is considered to have just arrived at the before-transfer point. The simulated timing signal triggers the control of the paper forwarding operation of the paper forwarding part 14 by the paper forwarding controller 29.

Next, the paper forwarding control on the paper forwarding part 14 by the paper forwarding controller 29 will be detailed below.

Figure 8:
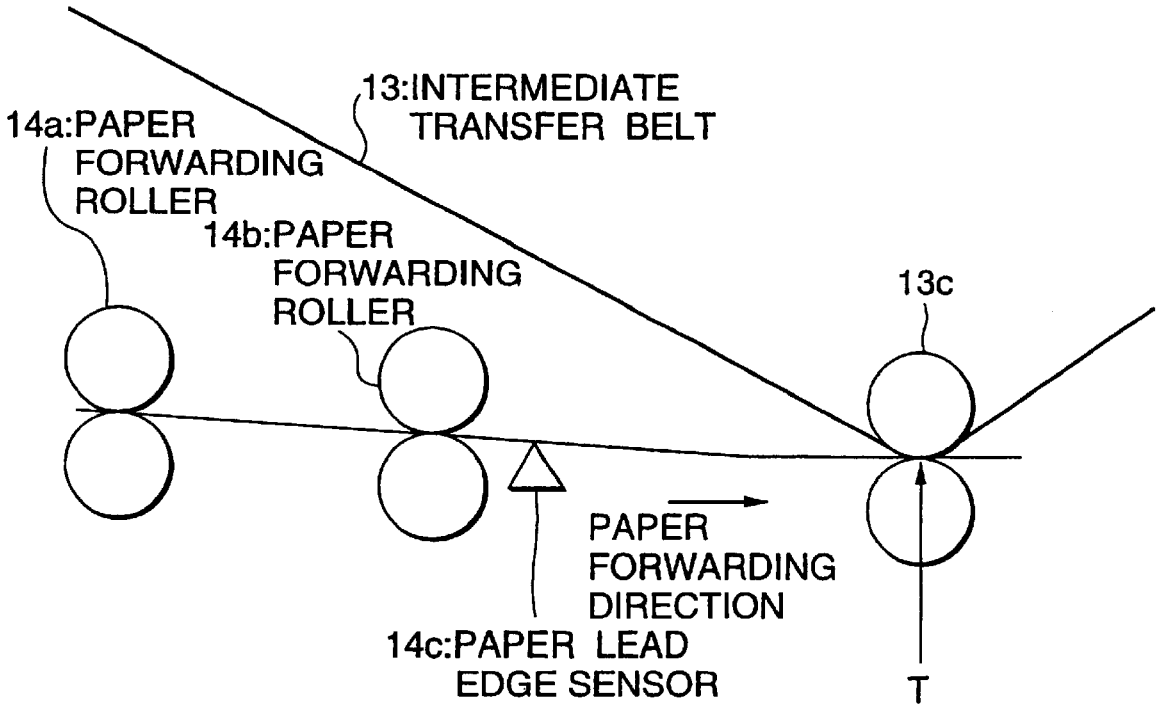
FIG. 8 is a schematic diagram showing an example configuration of a paper forwarding part.
Figure 9:
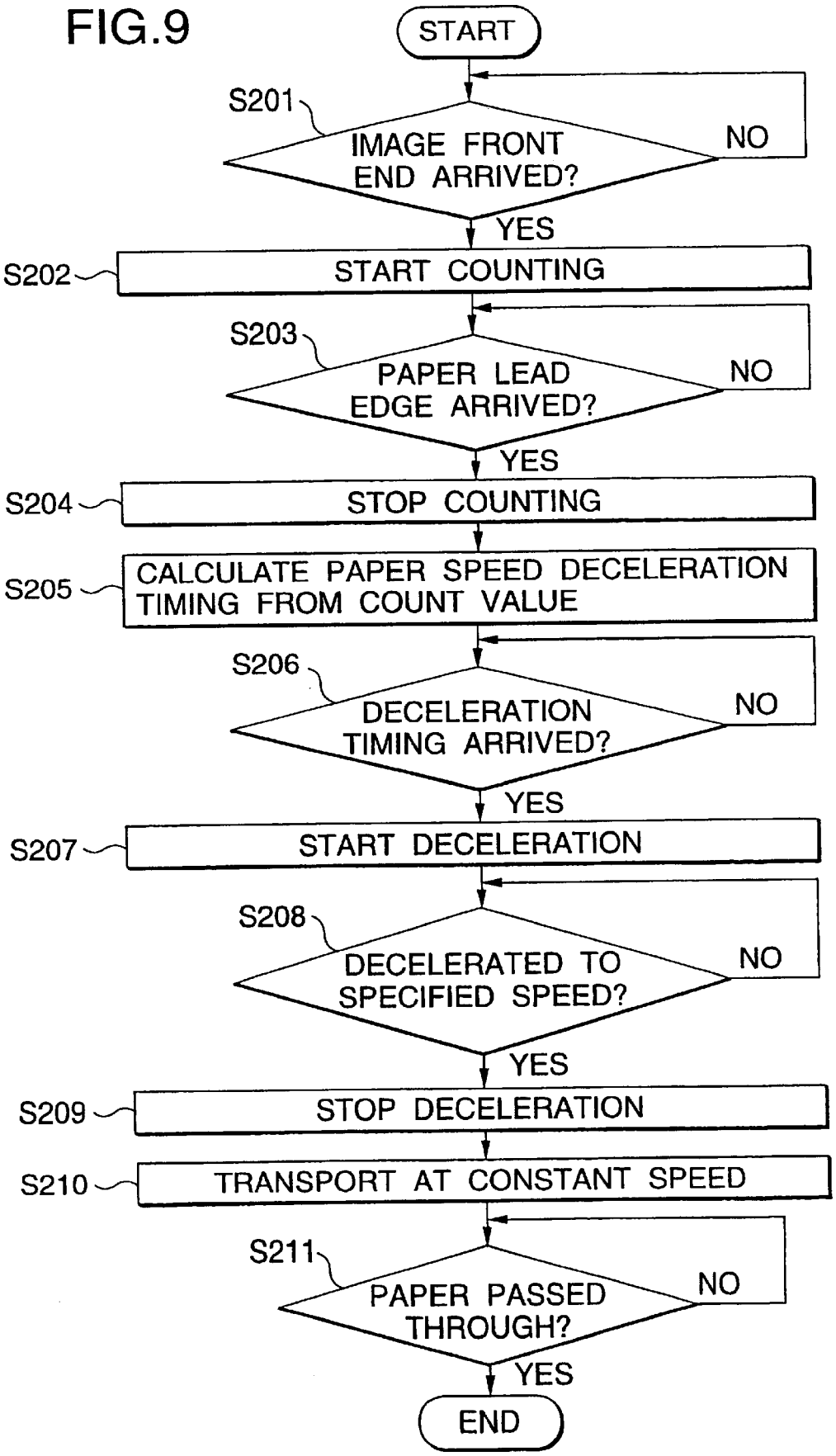
FIG. 9 is a flow chart showing an example control procedure performed on the paper forwarding part by a paper forwarding controller.

FIG. 8 is a schematic diagram showing an example configuration of the paper forwarding part and FIG. 9 is a flow chart showing an example control procedure performed by the paper forwarding controller.

The paper forwarding part 14 forwards the paper supplied from the paper transporting part 5 toward the image transfer position T in the transfer device. For this purpose, the paper forwarding part 14 has paper forwarding rollers 14*a*, 14*b* arranged along the paper forwarding direction and a paper lead edge sensor 14*c* provided on the downstream side of these paper forwarding rollers.

In the paper forwarding part 14 with the above arrangement, the paper forwarding rollers 14*a*, 14*b* holding the paper are rotated by a drive source (such as motor), not shown in the figure, to forward the paper toward the image transfer position T.

The paper forwarding part 14 needs to forward the paper so that the timing of the paper arriving at the image transfer position T coincides with the timing of the toner image arriving at the image transfer position T. At the same time, when the paper forwarding roller 14*b* on the downstream side in the paper forwarding direction holds the paper, it is necessary to eliminate possible paper position misregistration with respect to the paper forwarding roller 14*b* which are caused by variations in condition, such as, which part of the paper forwarding roller 14*b* the lead edge of the paper strikes, to what extent the lead edge of the paper is curled, and in what locus the paper has been transported.

Therefore, when the paper forwarding part 14 forwards the paper, the paper forwarding controller 29 controls the operations of the paper forwarding part 14 according to the procedure shown in FIG. 9.

First, the paper forwarding controller 29 monitors the output of the simulated timing signal from the image forming controller 30 to check for information indicating that the front end of the toner image on the intermediate transfer belt 13 is considered to have just arrived at the before-transfer point (S201). If the simulated timing signal is output, the paper forwarding controller 29 starts the count-up by its counter (S202).

The paper forwarding controller 29 causes the paper forwarding rollers 14*a*, 14*b* being rotated to hold the paper supplied from the paper transporting part 5 and forward it toward the image transfer position T. Then the paper forwarding controller 29 monitors the result of detection by the paper lead edge sensor 14*c* to see if the lead edge of the paper being forwarded by the paper forwarding rollers 14*a*, 14*b* has passed the paper lead edge sensor 14*c* (S204). When the lead edge of the paper has passed the paper lead edge sensor 14*c*, the count-up by the counter is ended (S204).

When the count-up is ended, the paper forwarding controller 29 calculates from the count value of the counter a timing of decelerating the paper forwarding speed (S205). The deceleration timing indicates when the paper forwarding speed should be decelerated in order to match the timing of the toner image arriving at the image transfer position T with the timing of the paper arriving there.

After it has determined the deceleration timing, the paper forwarding controller 29 checks whether the deceleration timing has come (S206). If it is decided that the deceleration timing has arrived, the paper forwarding controller 29 directs the drive source to decelerate the rotation speed of the paper forwarding rollers 14*a*, 14*b* (S207). When the rotation speed is decelerated to a specified speed (S208), the paper forwarding controller 29 stops deceleration (S209) and thereafter causes the paper forwarding rollers 14*a*, 14*b* and the drive source to operate at a constant forwarding speed (S210). The speeds before and after the deceleration are not in advance.

Then, when the trail edge of the paper passes the paper lead edge sensor 14*c* (S211), the paper forwarding controller 29 stops the paper forwarding rollers 14*a*, 14*b*, thus terminating the control procedure described above.

According to the simulated timing signal sent from the image forming controller 30, the paper forwarding controller 29 changes the speed of paper forwarding by the paper forwarding rollers 14*a*, 14*b* and thereby adjusts the paper forwarding speed. As a result, the timing at which the paper forwarded by the paper forwarding rollers 14*a*, 14*b* arrives at the image transfer position T coincides with the timing of the toner image arriving at the image transfer position T.

Although we have described a case of a non-stop servo registration control in which the paper forwarding controller 29 adjusts the paper forwarding speed by deceleration, the paper forwarding speed may be adjusted by acceleration and deceleration. Further, the timing of the paper arriving at the image transfer position T and the timing of the toner image arriving there may be matched by a stop servo registration control in which the paper forwarding controller 29 stops the paper forwarding rollers 14*a*, 14*b* when the paper lead edge sensor 14*c* detects the lead edge of the paper and then adjusts the timing of resuming the paper forwarding.

As described above, in the digital composite machine 1 of this embodiment, the image forming controller 30 calculates the time at which the front end of the toner image on the intermediate transfer belt 13 arrives at the predetermined point and corrects the calculated result as required. The paper forwarding controller 29, based on the calculated result presented by the image forming controller 30, controls the paper forwarding operation of the paper forwarding part 14. Therefore, the digital composite machine 1 is able to match the timing of the toner image arriving at the image transfer position T with the timing of the paper arriving there, without detecting by a sensor, variations of the timing at which the toner image arrives at the image transfer position T.

The digital composite machine 1 thus can match, with high precision, the timing of the toner image arriving at the image transfer position T and the timing of the paper arriving there, which in turn realizes a high quality image output. Further, if the intermediate transfer belt 13 elongates or contracts due to changes in temperature, humidity or belt tension, the influence of the belt elongation or contraction can be avoided because the image forming controller 30 can correct the calculated result.

Further, because the front end position of the toner image on the intermediate transfer belt 13 does not need to be detected by a sensor, the forming of toner patch on the intermediate transfer belt 13 becomes unnecessary, thus preventing an increase in equipment cost and in the development man-hours. Another advantage is that the detection of the front end position of the toner image on the intermediate transfer belt 13 no longer depends on the color of the coloring material. Still another advantage is that the conventional problem of extremely low productivity of the image formation is eliminated.

Further, because the problem of scattered toner deteriorating the detection precision or rendering the detection impossible is eliminated, the reliability of detection can be improved.

The digital composite machine 1 of this embodiment creates a simulated timing signal to notify the calculated result produced by the image forming controller 30 to the paper forwarding controller 29. That is, the paper forwarding controller 29 controls the operation of the paper forwarding part 14 based on the simulated timing signal, instead of a detection signal produced by a sensor which detects the toner image on the intermediate transfer belt 13. Hence, the paper forwarding controller 29 can easily perform the control because there is no need to detect the toner image on the intermediate transfer belt 13 by a sensor but the simulated timing signal can be used instead of the detection signal.

Further, in the digital composite machine 1 of this embodiment, the image forming controller 30 generates the simulated timing signal be using the counter 31 that operates in synchronization with the count source CLK. Thus, the image forming controller 30 can count with high precision the time which elapses from the input of the count start trigger to the output of the simulated timing signal. When the count time is to be corrected by changing the count-up register set value, it can be corrected with the precision of one clock of the count source CLK.

Further, in the digital composite machine 1 of this embodiment, the image forming controller 30 changes the count-up register set value of the counter 31 according to the elongation and contraction of the intermediate transfer belt 13. Thus, if the intermediate transfer belt 13 elongates or contracts due to changes in temperature, humidity or belt tension, the digital composite machine 1 can prevent the timing of the paper arriving at the image transfer position T and the timing of the toner image arriving there from deviating from each other.

While this embodiment has described an example case where the image forming controller 30 performs correction according to the elongation or contraction of the intermediate transfer belt 13, it is also possible to make corrections according to influencing factors such as parts mounting errors during the equipment assembly and dimensional precision of parts.

Further, the digital composite machine 1 of this embodiment detects the elongation or contraction of the intermediate transfer belt 13 based on the rotation cycle of the intermediate transfer belt 13 detected by the belt home position sensor 15*a* used for pitch control. Hence, the image forming controller 30 can detect the elongation or contraction of the intermediate transfer belt 13 reliably and appropriately. In addition, by using the belt home position sensor 15*a* to detect the home position of the intermediate transfer belt 13, the belt elongation or contraction can be detected with a simple construction without requiring a new dedicated sensor.

In the digital composite machine 1 of this embodiment, because the image forming controller 30 determines the time at which the front end of the toner image arrives at the before-transfer point, if there is any variation in the time required for transporting the toner image on the intermediate transfer belt 13 to the before-transfer point after the latent image has been written by the ROS 12, the variation can be absorbed by correcting the count-up register set value according to the variation.

This embodiment has described an example case where the variation in the time required for transporting the toner image on the intermediate transfer belt 13 to the before-transfer point after the latent image has been written by the ROS 12 is absorbed by determining the time at which the front end of the toner image arrives at the before-transfer point. In addition to this method, it is also possible to determine the time at which the front end of the toner image arrives at the image transfer position T instead of or in addition to the time at which it arrives at the before-transfer point. This latter method makes it possible to absorb variations in the time taken by the toner image on the intermediate transfer belt 13 to move from the before-transfer point to the image transfer position T.

The digital composite machine 1 of this embodiment performs the non-stop servo registration control (or stop servo registration control) in which when the paper lead edge sensor 14*c* detects the lead edge of the paper, the paper forwarding controller 29 changes the paper forwarding speed by the paper forwarding rollers 14*a*, 14*b* according to the simulated timing signal from the image forming controller 30 and thereby adjusts the paper forwarding speed. As a result of this control, the digital composite machine 1 can match the timing of the paper arriving at the image transfer position T with the timing of the toner image arriving at the image transfer position T reliably, without being affected by the state of the paper as it is pulled into the paper forwarding roller 14*b*.

Figure 10:
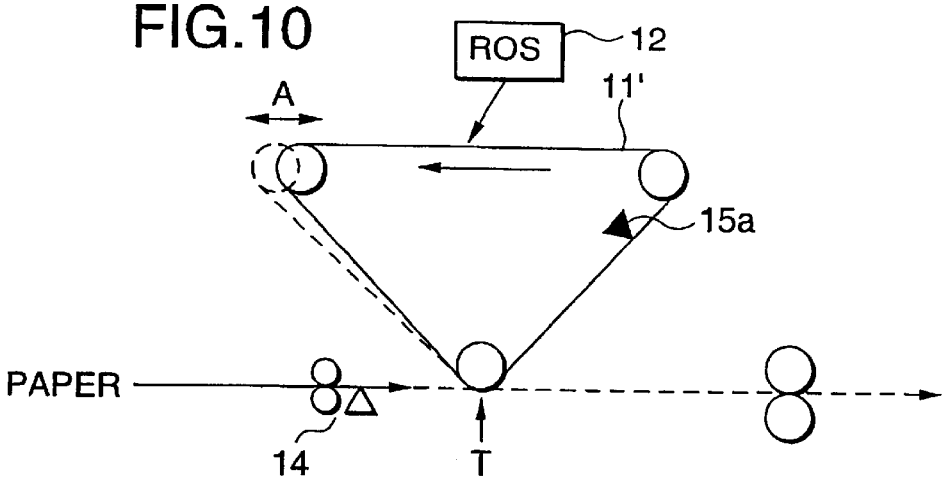
FIG. 10 is an explanatory view showing another example configuration of the image forming part in the image forming apparatus of the invention.

Although this embodiment has taken up an example case in which the image forming part 3 is of an intermediate transfer body type, this invention is not limited to this example. This invention can also be applied to a configuration of FIG. 10 for example, which has only the photosensitive belt 11' as the image carrier and in which the ROS 12 writes a latent image on the photosensitive belt 11' and the toner image formed by developing the latent image is transferred from the photosensitive belt 11' onto the paper. The same explanation also holds when the image carrier is only a photosensitive drum.

Figure 11:
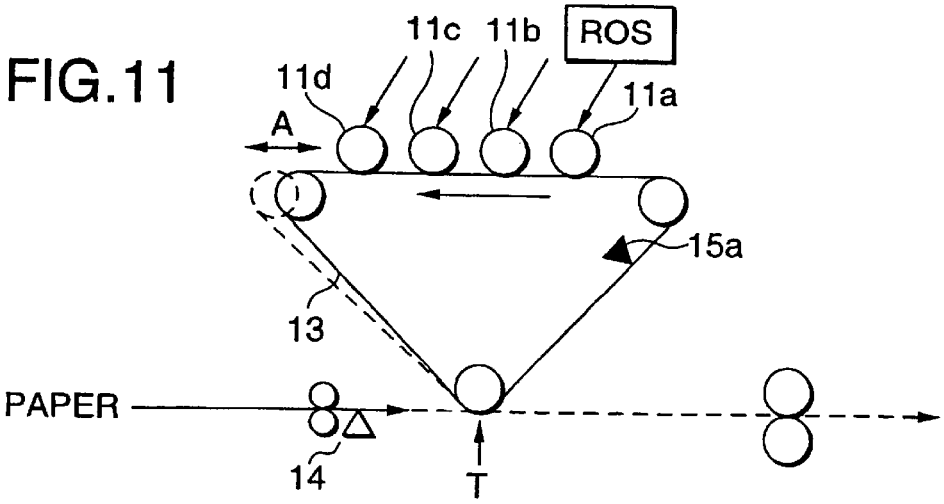
FIG. 11 is an explanatory view showing still another example configuration of the image forming part in the image forming apparatus of the invention.

While this embodiment has described an example case where the image forming part 3 is of a single engine type, the invention is not limited to this example. This invention can also be applied to at so-called tandem engine type for example, which, as shown in FIG. 11, has multiple photosensitive drums 11*a*–11*d* to viable fast formation of color images.

It is noted, however, that if the Image forming part 3 is of a tandem engine type, the engine naturally becomes large and thus the distance (time required) between the position where the count start trigger (e.g., the latent image write start timing signal for the ROS 12) is generated and the position where the simulated timing signal is generated (before-transfer point) becomes long. In such a case, the count value of the counter also increase so that the next count start trigger may be generated before the simulated timing signal corresponding to the previous count start trigger can be generated, thus overflowing the counter.

Figure 12:
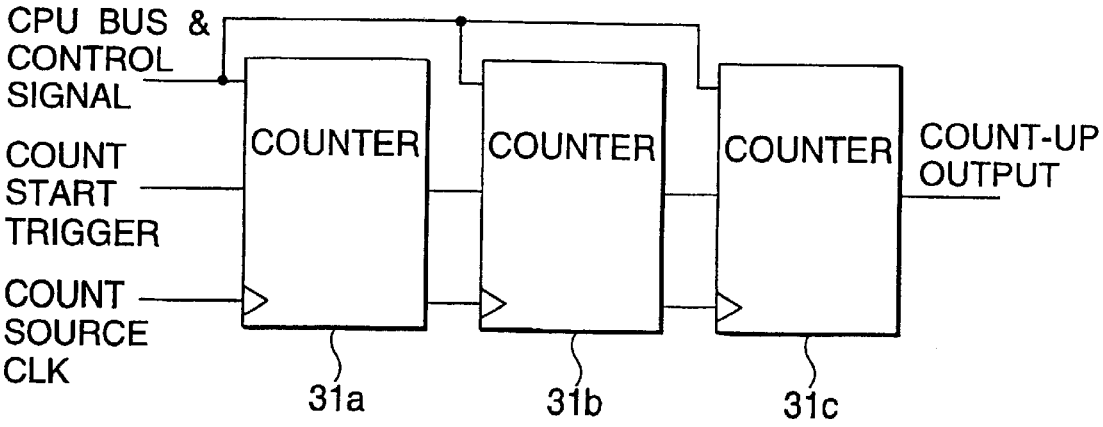
FIG. 12 is an explanatory view showing another example outline of the counter in the image forming controller.

Hence, where there is any possibility of counter overflow, the counters 31*a*–31*c* are connected in series and the output of the counter 31*c* situated at the final stage of these counters is used as a simulated timing signal, as shown in FIG. 12, to prevent the counter overflow. While this method is effective for the tandem engine type in which an overflow is likely to occur, it is similarly applicable to the single engine type with the possibility of the overflow problem.

In this cast, the count source CLK for these counters 31*a*–31*c* may be a line sync signal, a reference clock or encoder clock of the photosensitive drum 11, a reference clock or encoder clock of the intermediate transfer belt 13, or a paper forwarding clock. It should be noted that the count values of the counters 3l*a*–31*c* used to be set so that they do not exceed the pitch of the minimum paper size.

The timing of generating the simulated timing signal can be finally adjusted by changing the count-up register set value of any of the serially connected counters 31*a*–31*c*.

Further, the following counter control method may be employed. Each of the counters 3l*a*–31*c* is assigned a unique variable parameter, for example, by assigning the counter 31*a* with correction information on machine to machine variation of the difference between the count start trigger generation timing and the simulated timing signal generation timing, the counter 31*b* with correction information on the circumferential length of the intermediate transfer belt 13, and the counter 31*c* with correction information an machine to machine variation of the distance between the simulated timing signal generation position and the image transfer position T. This counter control method will greatly facilitate development of software that operates the counters 31*a*–31*c* and the image forming controller 30.

In the above counter control method, however, the count-up register set value is frequently corrected for the parameters that are greatly affected by temperature and humidity fluctuating in seconds or minutes, such as the circumferential length of the intermediate transfer belt 13. In such a case if the feedback response of the correction value is delayed, the misregistration in the paper transporting direction between the paper and the image deteriorates to that extent.

For example, when the paper containing a large amount of water passes through the fixing device that applies heat and pressure to the paper, hot and moist air quickly pervades in the apparatus and the intermediate transfer belt 13 absorbs moisture and is elongated. To detect the belt elongation, the intermediate transfer belt 13 must undergo one rotation, and therefore the response is delayed. Moreover, after the correction associated with the belt elongation has been made, additional time is required before the feedback of each counter 31*a*–31*c* can become effective, This problem may be alleviated an follows. When the counter control method that allocates variable parameters to individual counters is used, the sum value of all variable parameters is allocated to the downstream side, preferably the final stage counter 31*c* and the variable parameter that remains unchanged for a long period of time is allocated to the upstream counter 31*a*. With this arrangement, the correction value feedback response following the detection of variation can be improved for the constantly changing variable parameters.

Second Embodiment

Next, the second embodiment of the image forming apparatus of this invention will be described. Here, only the differences from the first embodiment will be explained.

Figure 13:
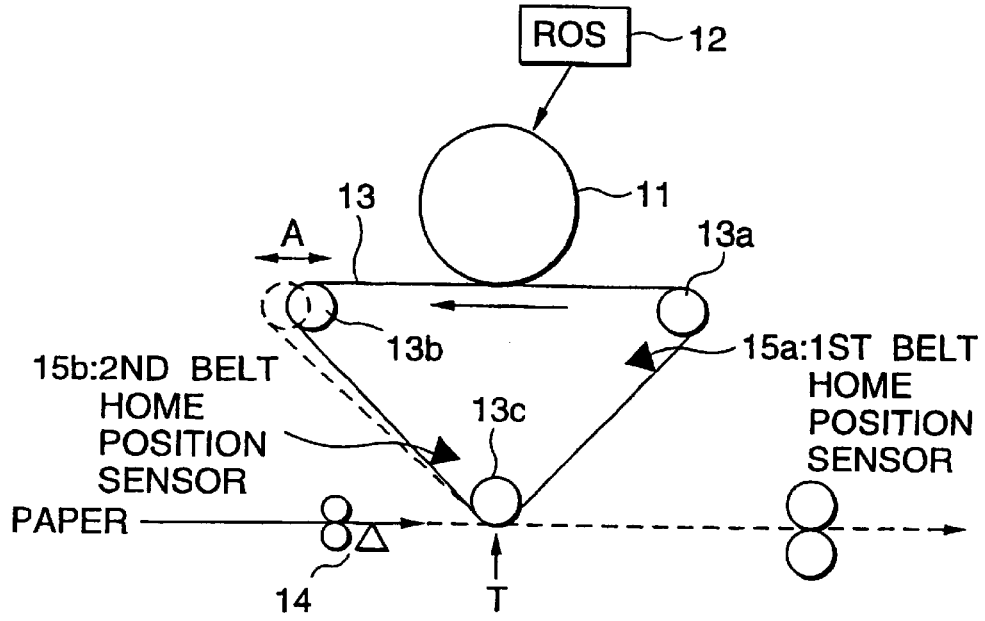
FIG. 13 is an explanatory view showing another example of how the intermediate transfer belt is elongated and contracted.
Figure 14:
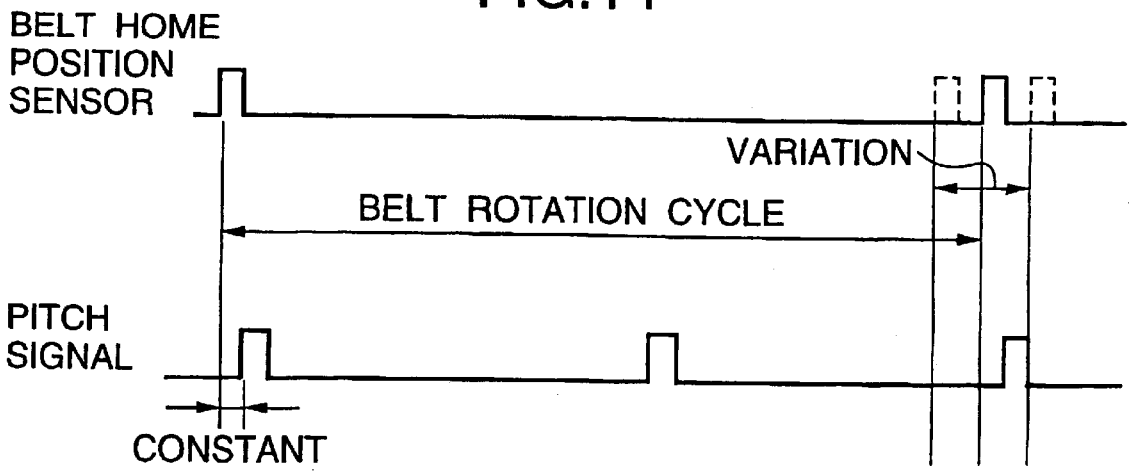
FIG. 14 is a timing chart showing another example outline of the control for even allocation of an image according to the elongation and contraction of the intermediate transfer belt.

FIG. 13 in an explanatory view showing how the intermediate transfer belt in the image forming part of this embodiment is elongated or contracted. FIG. 14 is a timing chart showing the outline of a control for even allocation of an image according to the elongation or contraction of the belt.

The distal composite machine of this embodiment, as shown in FIG. 13, differs from the first embodiment in that it has a second belt home position sensor 15*b* in addition to the belt home position sensor (hereinafter referred to as a "first belt home position sensor") 15*a*. That is, the image forming part 3 has multiple belt home position sensors 15*a*, 15*b* for detecting a home position provided beforehand on the intermediate transfer belt 13.

In this case, too, at least one of the belt home position sensors 15*a*, 15*b* is used for the pitch control to evenly allocate the toner image on the intermediate transfer belt 13 as shown in FIG. 7.

Where plural belt home position sensors 15*a*, 15*b* are used, the image forming controller 30 measures the time (lap time) which elapses after the first belt home position sensor 15*a* has detected the home position on the intermediate transfer belt 13 until the second belt home position sensor 15*b* detects the same home Position. By recognizing the amount of change in the lap time, the image forming controller 30 detects the elongation or contraction of the intermediate transfer belt 13.

Specifically, the image forming controller 30 detects the elongation or contraction of the intermediate transfer belt 13 by the following procedure.

Figure 15:
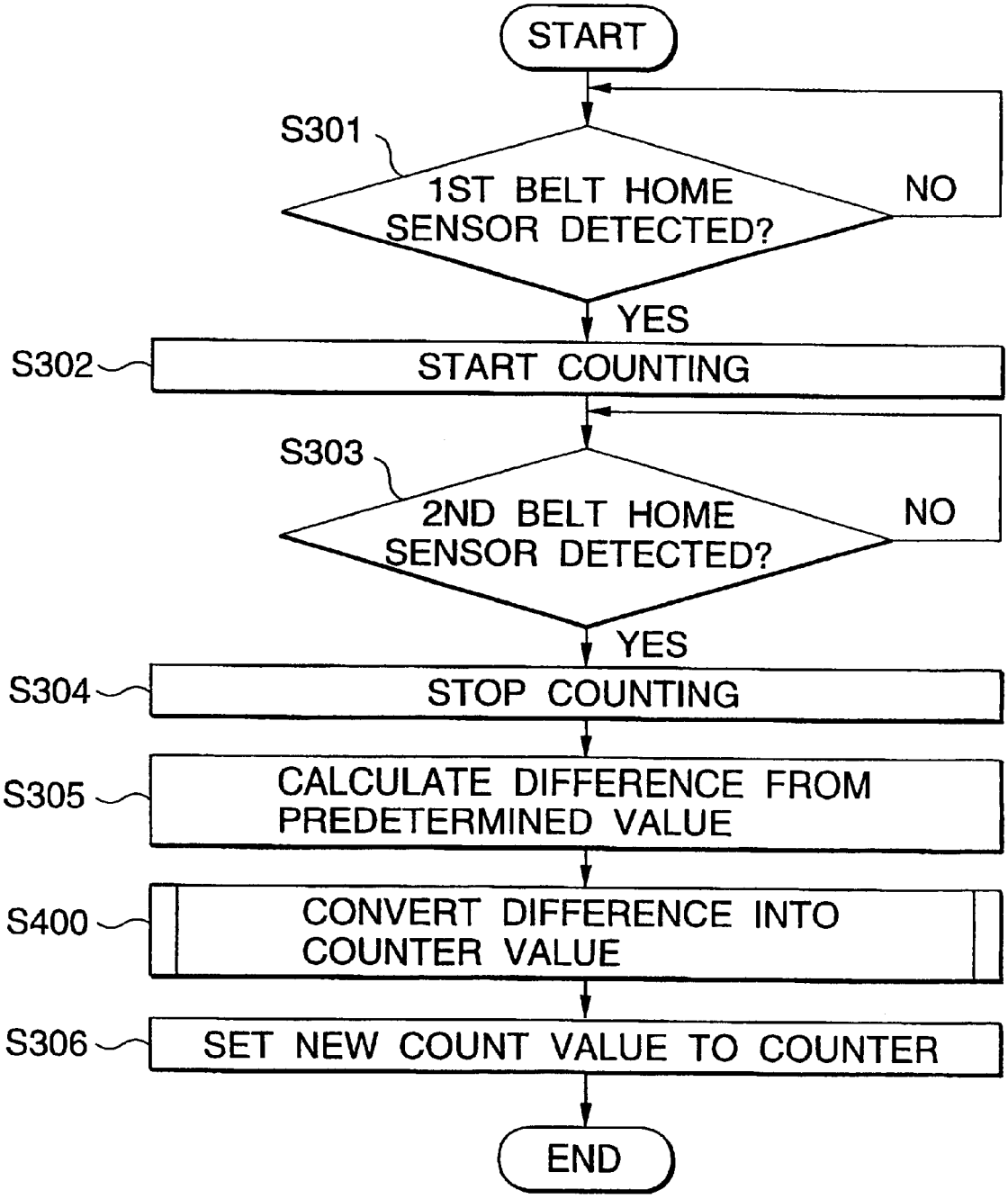
FIGS. 15 and 16 are flow charts showing an example operation performed by the image forming controller to detect the elongation and contraction of the intermediate transfer belt.
Figure 16:
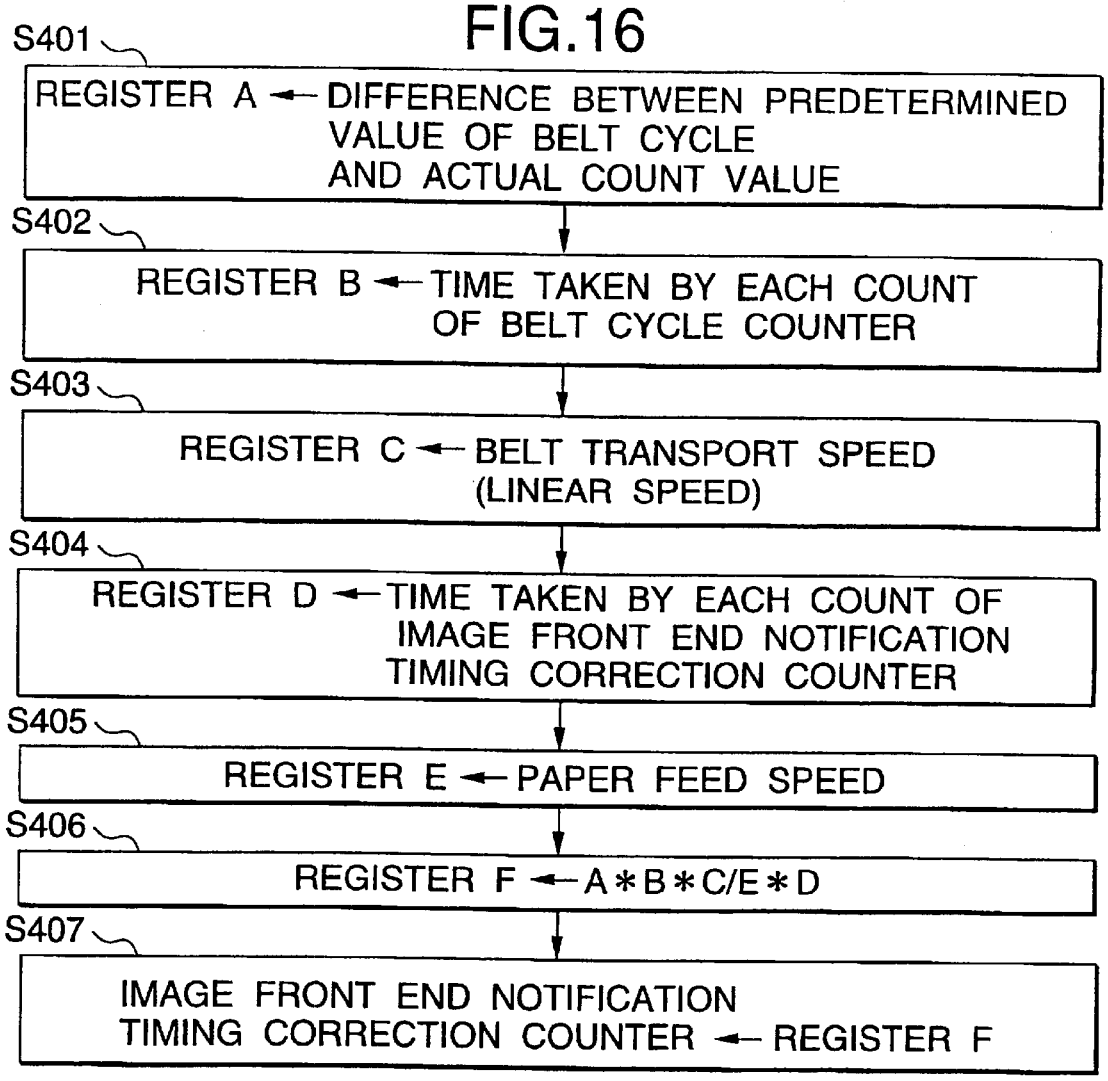

FIG. 15 and FIG. 16 are flow charts showing example operations performed by the image forming controller to detect the elongation or contraction of the intermediate transfer belt.

First, the image forming controller 30, as shown in FIG. 15, monitors the result of detection by the first belt home position sensor 15*a* to check whether the home position on the intermediate transfer belt 13 has been detected by the first belt home position sensor 15*a* (S301). When the home position is detected, the image forming controller 30 starts the count-up of its counter (S302).

The image forming controller 30 also monitors the result of detection by the second belt home position sensor 15*b* to check whether the home position that was detected by the first belt home position sensor 15*a* has been detected by the second belt home position sensor 15*b* (S303). When the home position is detected, the count-up of the counter is stopped (S304).

When the count-up is ended, the image forming controller 30 calculates the difference between the count value (lap time) of the counter and the corresponding predetermined value (S305). The difference between the lap time and the predetermined value is converted into a counter value in the counter 31, i.e., a value corresponding to the count-up register set value (S400).

This conversion is carried out according to the procedure shown in FIG. 16.

As shown in the procedure, the image forming controller 30 sets as a register value A the difference value obtained above, i.e., the difference between the belt cycle predetermined value and the actual count value or lap time (S401). Next, the image forming controller 30 sets the time taken by each count of the belt cycle counter as a register value B (S402). This time is determined depending on the kind (capability) of the belt cycle counter.

Further, the image forming controller 30 determines the belt moving speed (linear speed) of the intermediate transfer belt 13. This linear speed nay use a design value or may be determined from the rotation speed of the drive roller 13*a* that drives the intermediate transfer belt 13. The linear speed thus obtained is taken as a register value C (S403).

The image forming controller 30 sets as a register value D the time taken by each count of the counter 31 used to correct the toner image front end notification timing (S404). This time is also determined according to the kind (capability) of the counter 31. Further, the image forming controller 30 takes the paper forwarding speed of the paper forwarding part 14 as a register value E (S405). This speed is a set speed before the acceleration or deceleration is performed by the paper forwarding controller 29.

Based on these register values A–E, the image forming controller 30 calculate "value A×value B×value C/value E×value D" and takes the result of this calculation as a register value F (S406). This register value F corresponds to the count-up register set value (S407).

After the difference is converted into the value corresponding to the count-up register set value, the CPU in the image forming controller 30 sets the converted value (register value A in a register in the counter 31 as a new count-up register set value (S306), as shown in FIG. 15.

As described above, the digital composite machine 1 of this embodiment detects the elongation and contraction of the intermediate transfer belt 13 from the amount of change in the lap time measured from the result of detection by plural belt home position sensors 15*a*, 15*b*. Hence, the detection of the elongation and contraction of the intermediate transfer belt 13 is not influenced by mounting position errors of the drive roller 13*a* and the tension roller 13*b* of the intermediate transfer belt 13 or by changes in the roller diameters due to thermal expansion. Therefore, this digital composite machine can detect the elongation or contraction of the intermediate transfer belt 13 with higher precision than in the first embodiment it which the rotation cycle of the intermediate transfer belt 13 is detected. This in turn allows the variation of the timing at which the toner image arrives at the image transfer position T to be corrected with highly precisely.

Third Embodiment

Next, the third embodiment of the image forming apparatus of the invention will be described. Only the differences from the first and second embodiments will be explained here as well.

Figure 17:
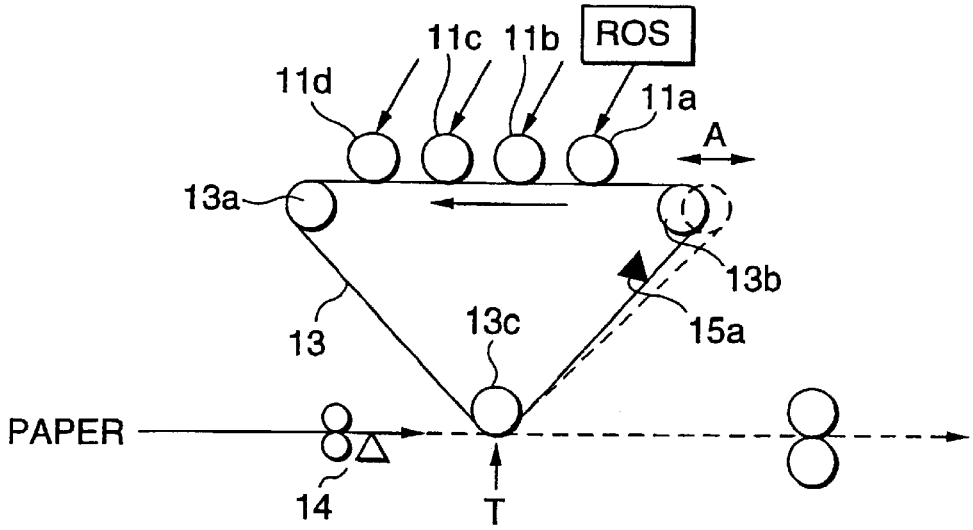
FIG. 17 is an explanatory view showing a further example configuration of the image forming part in the image forming apparatus of the invention.

FIG. 17 in an explanatory view showing an example construction of an essential portion of the digital composite machine of this embodiment.

As shown it the figure, the digital composite machine of this embodiment differs from the first and second embodiments in that the tension roller 13*b* that gives tension to the intermediate transfer belt 13 is located downstream of the image transfer position T in the transfer device in the rotation direction of the intermediate transfer belt 13 and also upstream of the position of the photosensitive drum 11 in the rotation direction of the intermediate transfer belt 13.

Generally, when the intermediate transfer belt 13 elongates or contracts, the tension roller 13*b* moves in its position to keep the tension constant. Where the tension roller 13*b* is arranged as described above, the distance between the position of the photosensitive drum 11 and the image transfer position T in the transfer device. i.e., the distance from the point where the toner image is transferred onto the intermediate transfer belt 13 to the point where the toner image arrives at the image transfer position T, is affected less by the positional change of the tension roller 13D than in the previous embodiments.

Therefore, according to this embodiment, the arrangement of the tension roller 13*b* downstream of the image transfer position T and upstream of the photosensitive drum 11 can minimize the extent to which the time from the generation of the count start trigger to the generation of the simulated timing signal is affected by the presence of a factor that greatly changes in a short period of time, such as the circumferential length of the intermediate transfer belt 13. That is, this arrangement can prevent the count-up register met value from being corrected frequently, which is very preferable to the control processing by the image forming controller 30.

It is noted that the arrangement of the tension roller 13*b* described above is effective whether the apparatus is of a single engine type or a tandem engine type, as long as it uses the intermediate transfer belt 13. It is also effectively applied to an apparatus that has a photosensitive belt as the image carrier.

Fourth Embodiment

Next, the fourth embodiment of the image forming apparatus of the invention will be described. Only the differences from the first to third embodiments will be explained horn as well.

In the first to third embodiments we have described the case where the image forming controller 30 corrects the timing at which the simulated timing signal is generated according to the degree to which the intermediate transfer belt 13 elongates or contract. In contrast, the digital composite machine of this embodiment is characterized in that the image forming controller 30 generates the simulated timing signal irrespective of the elongation of contraction of the intermediate transfer belt 13 and that the paper forwarding controller 29 controls the paper forwarding operation of the paper forwarding part 14 according to the simulated timing signal and the degree of elongation or contraction of the intermediate transfer belt 13.

More specifically, in FIG. 1, when the belt home position sensor 15*a* (or the first belt home position sensor 15*a* and the second belt home position sensor 15*b*) detects the elongation or contraction of the intermediate transfer belt 13, the image forming controller 30 notifies to the paper forwarding controller 29 the simulated timing signal, which was generated without performing the timing correction, and the result of detection of elongation/contraction of the intermediate transfer belt 13 as information related to paper forwarding. Upon receiving the paper forwarding associated information from the image forming controller 30, the paper forwarding controller 29 controls the paper forwarding operation of the paper forwarding part 14 (adjustment of the timing at which the paper arrives a the image transfer position T) according to the received information.

With this control also, the digital composition machine can match with high precision the timing of the toner image arriving at the image transfer position T and the timing of the paper arriving there, and thus produce the similar effects to those explained in the first embodiment.

Where the image forming controller 30 and the paper forwarding controller 29 perform the controls as described above, the status change of the factor that affects the elongation/contraction of the intermediate transfer belt 13 and the toner image front and arrival timing may be directly detected by the paper forwarding controller 29 rather than by the image forming controller 30. The paper forwarding controller 29 may also receive the latent image write start timing signal for the ROS 12 from the image forming controller 30 and generate the simulated timing signal itself by taking the received timing signal as a reference.

Fifth Embodiments

Next, the fifth embodiment of the image forming apparatus of the invention will be described.

The first to fourth embodiments have described the case where the misregistration in the positional relation between the toner image and the paper results mainly from the elongation/contraction of the intermediate transfer belt 13. In reality, however, there are various other factors that cause the positional relation misregistration. Here we will give detailed explanation about these factors and examples of detection.

(1) Changes in circumferential length of the belt

Among He factors Causing Variations in the positional relation between the toner image and the piper is, first of all, an elongation or contraction of the intermediate transfer belt 13, i.e., a change in circumferential length of the intermediate transfer belt 13, as explained in the first to fourth embodiments. Therefore, to prevent any positional misregistration between the toner image and the paper, it is necessary to detect the circumferential length of the intermediate transfer belt 13 and, based on the detection result, control the paper forwarding operation.

The circumferential length of the intermediate transfer belt 13 may be detected either from the rotation cycle of the intermediate transfer belt 11 detected by the belt home position sensor 15*a*, an explained in the first embodiment, or from the lap time detected by the first belt home position sensor 15*a* and the second belt home position sensor 15*b*, as explained in the second embodiment.

It is also possible to detect the circumferential length of the intermediate transfer belt 13 based an the variation in the physical distance or axis-to-axis distance between the rollers 13*a*–13*c* around which the intermediate transfer belt 13 in supported in a tense state. That is, the variation in the axis-to-axis distance between the drive roller 13*a* and the tension roller 13*b* or the Positional variation of the tension roller 13*b* is measured by using a length measuring sensor and a change in the circumferential length of the intermediate transfer belt 13 can be known from the result of measurement. Hence, by detecting the circumferential length of the belt from the result of measurement, the paper forwarding operation may be controlled.

(2) change in linear speed and belt circumferential length due to change in drive roller diameter The intermediate transfer belt 13 is driven by the drive roller 13*a*. Hence, when the diameter of the drive roller 13*a* changes due to thermal expansion from temperature rise or due to wear, the linear speed of the intermediate transfer belt 13 driven by the drive roller 13*a* will change even when the angular speed of the drive roller 13*a* remains constant. This may cause at misregistration in the positional relation between the toner image and the paper. To eliminate a possible misregistration in the positional relation resulting from a change in the linear speed of the intermediate transfer belt 13, the linear spend (circumferential speed) of the intermediate transfer belt 13 needs to be detected and, based on the detection result, the paper forwarding operations controlled.

The linear speed of the intermediate transfer belt 13 can be detected based on the lap time detected by the first belt home position sensor 15*a*, and the second belt home position sensor 15*b* and on the distance between these sensors 15*a* and 15*b*. If the linear speed of the intermediate transfer belt 13 is detected, it is possible to calculate a change in the circumferential length of the belt from the result of detection.

(3) Parts mounting error

The misregistration in the positional relation between the toner image and the paper is also produced by the mounting error of the ROS 12, for example. That is, when there are variations among engines of the ROS 12 mounting position, the position of exposure by the ROS 12 on the photosensitive drum 11 varies. Such misregistration can be eliminated by detecting the amount of ROS 12 mounting error and controlling the paper forwarding operation according to the result of detection.

The amount of ROS 12 mounting error may be detected as follows. For example, a linear-arrayed CCD (charge-coupled device) sensor is arranged near the end of the photosensitive drum 11 in a direction perpendicular to the scan direction of the ROS 12. Then, the bean from the ROS 12 is detected by the CCD sensor to detect the amount of ROS 12 parts mounting error.

The parts mounting error can also occur in other parts (specified components such as photosensitive drum 11 and the intermediate transfer belt 13) in addition to the ROS 12. These mounting errors can be measured by transferring the toner image onto the paper temporarily and reading the amount of misregistration of the toner image on the paper by a dedicated sensor (such as CCD sensor), or visually inspecting it by a maintenance staff.

(4) Amount of misregistration among toner images of different colors

The image forming part 3 of tandem engine type generally has a function to detect the amount of misregistration among the toner Images of different colors and correct the misregistration (color registration deviation detection/correction, function; hereinafter referred to as "color misregistration detection sensors") so that the toner images formed on the photosensitive drums 11*a*–11*d* can be superimposed together on the intermediate transfer belt 13. That is, the color misregistration detection sensors detect the amount of color misregistration on the intermediate transfer belt 13 in a sub-scan direction. The amount of color misregistration is usually produced by the expansion of casing due to temperature changes in the apparatus.

Figure 18:
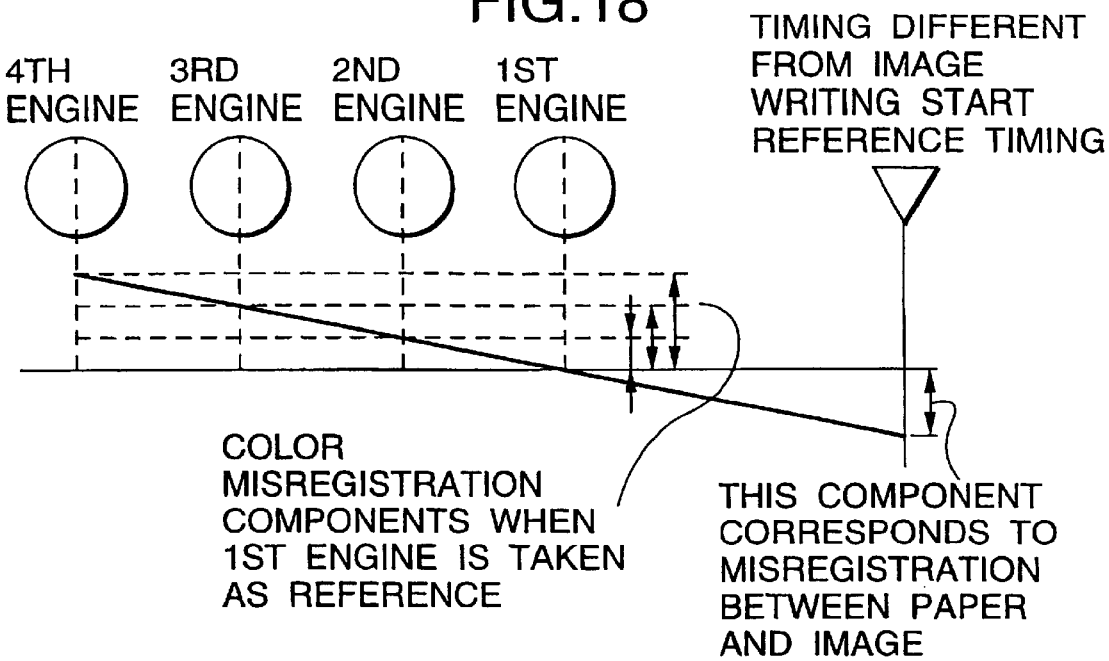
FIG. 18 is an explanatory view showing an outline of drum position misregistrations in a tandem engine system.
Figure 19:
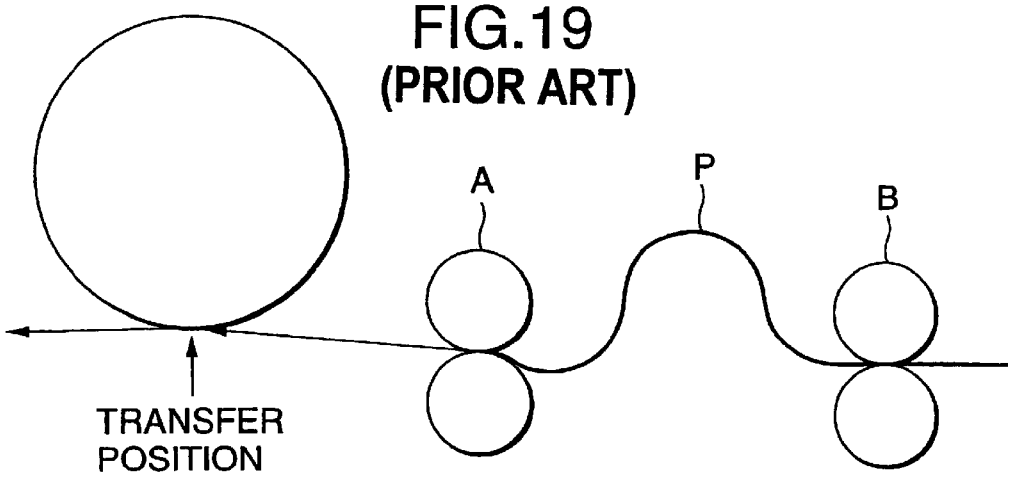
FIG.19 (PRIOR ART)
FIG. 19 is a schematic diagram showing an example outline of a conventional paper forwarding.
Figure 20A:
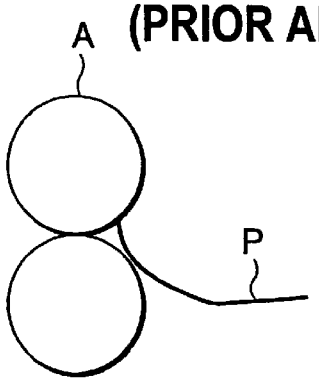
FIG.20A (PRIOR ART)
FIGS. 20A and 20B are explanatory views showing the states of the lead edge of paper in the conventional apparatus.
Figure 20B:
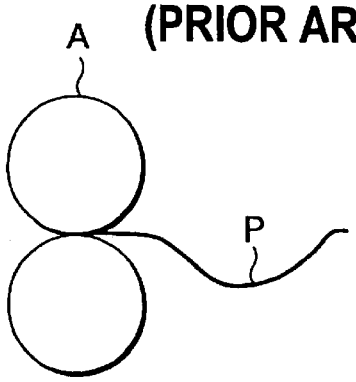
FIG.20B (PRIOR ART)
Figures 21A, 21B:
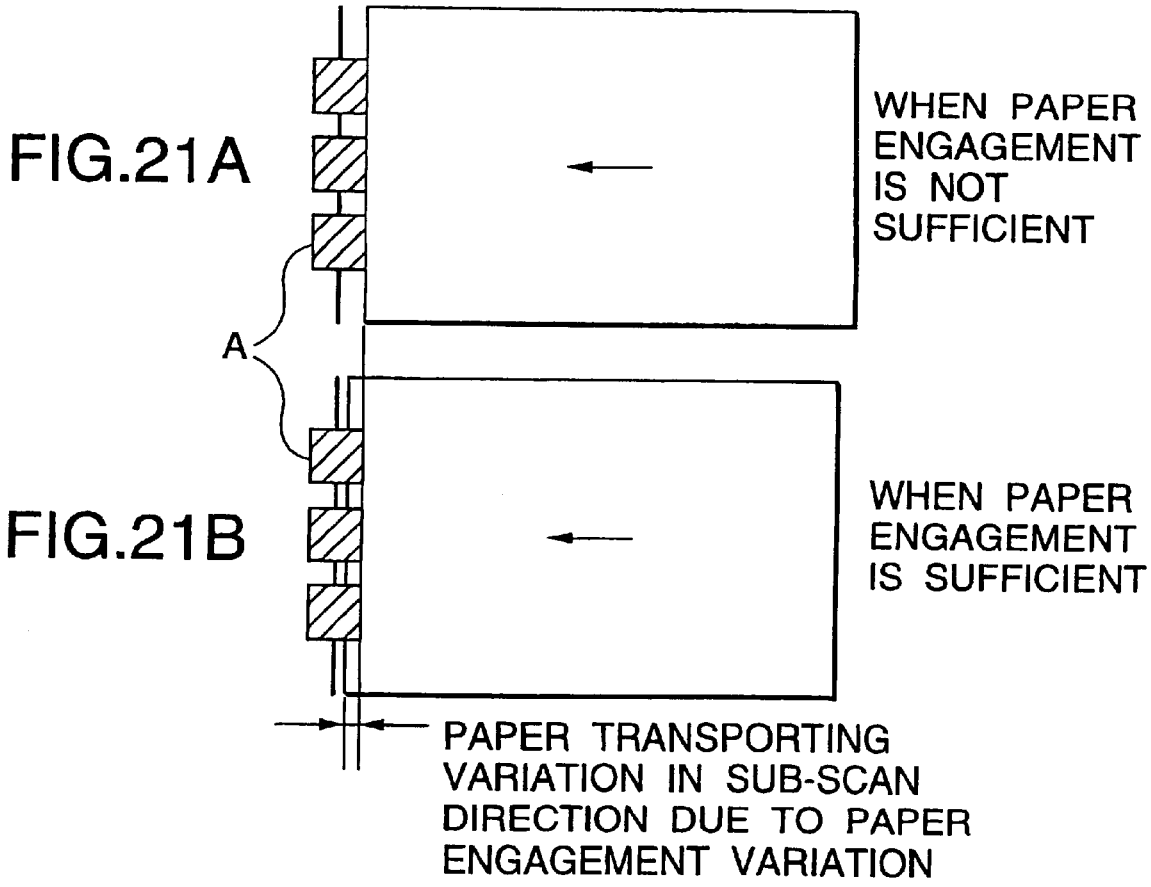
FIGS. 21A and 21B are explanatory views showing positional relations between the roller and the paper.

The color misregistration detection sensors normally detect relative positional misregistration among different colors images. In four-engine tandem apparatus, the first photosensitive drum (first engine) 11*a* to the fourth photosensitive drum (fourth engine) 11*d* are arranged at equal intervals and therefore, as shown in FIG. 18, the relative positional misregistration exhibits a characteristic which is almost linearly proportional to the expansion of the casing. By using this linear characteristic, it is possible to detect the deviation of the image write timing for the first engine from the image write start timing.

This timing deviation corresponds to a misregistration of the positional relation between the toner image and the paper and thus can be taken as the amount of correction. That is, by detecting the amount of misregistration among different color images, it is possible to eliminate a possible misregistration of the positional relation between the toner image and the paper.

The characteristic of the misregistration amount need not be linear but can be a quadratic curve as long as it can define the relation between the toner image and the paper. Rather than taking the first engine as a reference, other engine may of course be used as a reference in detecting the color misregistration.

(5) change in position of photosensitive drum

The positional misregistration between the toner image and the paper can also be produced by the photosensitive drum 11 deviating in position with respect to the intermediate transfer belt 13. The positional change of the photosensitive drum 11 can be produced by expansion of the casing due to temperature rises in the apparatus or by external factors such as impacts. The misregistration of the positional relation between the toner image and the paper therefore can be prevented by detecting the amount of positional shift of the photosensitive drum 11 as by the color misregistration detection sensors or dedicated position measuring sensors or the like.

(6) Temperature and humidity changes

As the ambient temperature changes, the circumferential length of the intermediate transfer belt 13 changes because of its thermal expansion and so do the diameters of the drive roller 13*a* and the tension roller 13*b*. The magnitudes of these changes are determined by the material of the intermediate transfer belt 13, i.e., the thermal expansion rate of the material. That is, the change in the circumferential length of the intermediate transfer belt 13 can be estimated. By estimating the change in the circumferential length of the intermediate transfer belt 13, it is possible to determine to what extent the toner image and the paper will deviate from each other and therefore to eliminate a possible misregistration in the positional relation between the toner image and the paper.

To describe more specifically, if the relation between these variations and the temperature is represented by a function or mapped into a table of values beforehand, it is possible to eliminate the positional relation misregistration between the toner image and the paper by detecting the temperature in the apparatus by a temperature sensor. Further, by arranging the temperature sensor close to the intermediate transfer belt 13, a higher precision can be obtained. In other words, the use of the function or table values described above enables a possible change in the circumferential length of the intermediate transfer belt 13 to be estimated from the result of temperature detection, thus making it possible to determine to what extent the toner image and the paper will deviate from each other.

What has been described above applies not only to temperature but also to humidity. That is, a change in circumferential length of the intermediate transfer belt 13 may be estimated from the detection result of humidity in the apparatus or from both temperature and humidity. Where a possible circumferential length change is estimated based on the humidity detected, a higher precision can be obtained if the humidity sensor is located close th the intermediate transfer belt 13.

When one of the factors (parameters) in the above (1) to (6) or any combination of these is detected, the image forming controller 30 corrects the misregistration of the positional relation between the toner image and the paper according to the result of detection.

While the first to fourth embodiments have dealt with the case where the paper forwarding timing or speed is changed to correct the misregistration of the positional relation between the toner image and the paper, the positional relation misregistration can also be corrected as described in (7) and (8).

(7) Adjustment of ROS writing timing

The image forming controller 30 may direct the video controller 26 to adjust the ROS 12 write timing in the subs-scan direction to change the position on the intermediate transfer belt 13 where the toner image will be carried.

(8) Adjustment of angular speed of rotation of photosensitive drum

Adjusting the angular speed of rotation of the photosensitive drum 11 results in a change in the time which elapses from the point of exposure by the ROS 12 to the point of transfer onto the intermediate transfer belt 13. The angular speed adjustment therefore can change the position of the toner image on the intermediate transfer belt 13. Hence, the image forming controller 30 may direct the photosensitive body controller 27 to adjust the angular speed of rotation of the photosensitive drum 11 to change the toner image position on the intermediate transfer belt 13.

That is, according to the result of detection of one or more of the parameters (1) to (6) described above, the image forming controller 30 corrects the misregistration of the positional relation between the toner image and the paper by executing one, or any combination, of the paper forwarding control through the paper forwarding controller 29, the ROS 12 write timing control through the video controller 26 and the photosensitive drum rotation angular speed control through the photosensitive body controller 27.

As described above, the digital composite to machine of this embodiment controls at least one of the paper forwarding operation of the paper forwarding part 14 and the image forming operation of the image forming part 3 according to the parameters contributing to the misregistration of the positional relation between the toner image and the paper. The digital composite machine therefore can correct the misregistration of the positional relation between the toner image and the paper in a manner similar to the first embodiment.

As described above, the image forming apparatus of this invention calculates the point in time at which the image on the image carrier will arrive at the image transfer position or nearby position, corrects the result of calculation as required, and controls the operation of forwarding the paper to the image transfer position according to the result of calculation. In this image forming apparatus, therefore, the timing of the image arriving at the image transfer position can be made to match the timing of the paper arriving there, without having to detect with a sensor variations of the timing at which the image arrives at the image transfer position.

This image forming apparatus can realize a high quality image output and, if the image carrying surface of the image carrier should elongate or contract, can protect the image against being affected by the elongation or contraction, by correcting the result of calculation obtained from the calculation unit. Further, because there is no used to detect the image an the image carrier as by a sensor, it in not necessary to form a toner patch on the image carrier, which in turn prevents an increase in the apparatus cost and in the number of development processes. Another advantage is that the apparatus of the invention is free from the conventional problems that the detection of an image an the image carrier depends on the color of the coloring material and that the productivity of image forming in very low. Furthermore, because the toner is no longer scattered, the problem of degraded detection precision or detection failure is eliminated, assuring improved reliability of detection.

What is claimed is:

1. An image forming apparatus comprising:

an image forming unit that forms an image on an image carrier;

a transfer unit the transfers the image formed on the image carrier by the image forming unit onto paper;

a transporting unit that transports the paper toward the transfer unit;

a calculation unit that calculates a time when the image on the image carrier will arrive at an image transfer position of the transfer unit or nearby position and corrects the calculated result according to a predetermined parameter; and a control unit the controls the paper transporting operation of the transporting unit according to the time determined by the calculation unit.

2. The image forming apparatus according to claim 1, wherein the calculation unit notifies the calculated time to the control unit by a simulated timing signal generated by the calculation unit.

3. The image forming apparatus according to claim 2, wherein the simulated timing signals a signal which is output when a count value of a counter that operates in synchronization with a predetermined clock and is triggered by the start of an image forming operation of the image forming unit reaches a preset value.

4. The wage forming apparatus according to claim 3, further comprising:

an elongation/contraction detection unit that detects an elongation or contraction of an image carrying surface of the image carrier;

wherein the calculation unit corrects the calculated result by changing the preset value using the result of detection by the elongation/contraction detection unit an a predetermined parameter.

5. The image forming apparatus according to claim 4, wherein the elongation/contraction detection unit has a detector that detects a reference point provided on the image carrying surface and detects the elongation or contraction of the image carrying surface according to a variation of a rotation cycle of the image carrier that is recognized from the result if detection by the detector.

6. The image forming apparatus according to claim 4, wherein the elongation/contraction detection unit has a plurality of detectors each of which detects a reference point provided on the image carrying surface, and detects the elongation at contraction of the image carrying surface according to a variation of a time required by each of the detectors than is recognized, from a difference between times taken by the detectors to detect the reference point.

7. The image forming apparatus according to claim 5, wherein at least one of the detectors is used for a pitch control to keep correct a pitch between a plurality of images formed on the image carrier by the image forming unit.

8. The image forming apparatus according to claim 3, wherein the calculation unit changes the preset value to correct a variation of a time from formation of the image on the image carrier by the image forming unit until arrival of the image at a point near the image transfer position of the transfer unit.

9. The image forming apparatus according to claim 3, wherein the calculation unit changes the preset value to correct a variation of a time required for moving the image on the image carrier from a point near the image transfer position of the transfer unit to the image transfer position.

10. The image forming apparatus according to claim 1, wherein the control unit comprises:

a forwarding unit that forwards the paper transported by the transporting unit to the image transfer position of the transfer unit;

a lead edge detection unit provided between the transfer unit and the forwarding unit that detects a lead edge of the paper forwarded by the forwarding unit; and an adjusting unit that, when the lead edge detection unit detects the lead edge of the paper, changes a forwarding speed of the forwarding Unit to adjust at least one of a paper transporting speed and a paper transporting timing.

11. The image forming apparatus according to claim 1, wherein the image carrier is formed like an endless belt and supported by a plurality of rollers, at least one of the rollers being a tension roller to keep the image carrier in a tensed state, and the tension roller is arranged downstream of the image transfer position of the transfer unit in a direction in which the image carrying surface of the image carrier moves and upstream of an image forming position of the image forming unit in the image carrying surface moving direction.

12. The image forming apparatus according to claim 2, further comprising:

an elongation/contraction detection unit that detects an elongation or contraction of the image carrying surface of the image carrier, wherein the calculation unit generates a simulated timing signal without correcting the calculated result and regardless of the result of detection by the elongation/contraction detection unit, and wherein the control unit controls the paper transporting operation of the transporting unit according to the result of detection by the elongation/contraction detection unit and to the simulated timing signal from the calculation unit.

13. An image forming apparatus comprising:

an image carrier belt shaped like an endless belt;

an image forming unit that forms an image on the image carrier belt;

a transfer unit that transfers the image formed on the image carrier belt by the image forming unit onto paper;

a transporting unit that transports the paper toward the transfer unit;

a length detection unit that detects a circumferential length of the image carrier belt; and a control unit that controls at least one of the paper transporting operation of the transporting unit and the image forming operation of the image forming unit according to a result of detection by the length detection unit.

14. An image forming apparatus comprising:

an image carrier belt shaped like an endless belt;

an image forming unit that forms an image on the image carrier belt;

a transfer unit that transfers the image formed on the image carrier belt by the image forming unit onto paper;

transporting unit that transports the paper toward the transfer unit;

an inter-axis distance detection unit that detects an axis-to-axis distance between rollers or an amount of variation of the axis-to-axis distance, the rollers being provided to tones the image carrier belt; and a control unit that controls at least one of the paper transporting operation of the transporting unit and the image forming operation of the image forming unit according to a result of detection by the inter-axis distance detection unit.

15. An image forming apparatus comprising:

an image carrier belt shaped like an endless belt;

an image forming unit that forms an image on the image carrier belt;

a transfer unit that transfers the image formed on the image carrier belt by the image forming unit onto paper;

a transporting unit that transports the paper toward the transfer unit;

a speed detection unit that detects, a change in a circumferential speed of the image carrier belt; and a control unit that controls at least one of the paper transporting operation of the transporting unit and the image forming operation of the image forming unit according to a result of detection by the speed detection unit.

16. An image forming apparatus comprising:

an image carrier belt shaped like an endless belt;

an image forming unit that forms an image on the image carrier belt;

a transfer unit that transfers the image formed on the image carrier belt by the image forming unit onto paper;

a transporting unit that transports the paper toward the transfer unit;

an error amount recognition unit that recognizes an amount of error in mounting support parts of the image carrier belt and constitutional parts of the image forming unit, the transfer unit and the transporting unit; and a control unit that controls at least one of the paper transporting operation of the transporting unit and the image forming operation of the image forming unit according to a result of recognition by the error amount recognition unit.

17. An image forming apparatus comprising:

an image carrier belt shaped like an endless belt;

an image forming unit that forms a plurality of images of different colors superimposed on the image carrier belt;

a transfer unit that transfers the image formed on the image carrier belt by the image forming unit onto paper;

a transporting unit that transports the paper toward the transfer unit;

a color misregistration detection unit that detects an amount of misregistration among the plurality of color images formed on the image carrier belt; and a control unit that controls at least one of the paper transporting operation of the transporting unit and the image forming operation of the image forming unit according to a result of detection by the color misregistration detection unit.

18. An image forming apparatus comprising:

an image carrier belt shaped like an endless bolt;

an image forming unit that forms an image on the image carrier belt;

a transfer unit that transfers the image formed on the image carrier belt by the image forming unit onto paper;

a transporting unit that transports the paper toward the transfer unit;

a position detection unit that detects a variation of a position of the image forming unit; and a control unit that controls at least one of the paper transporting operation of the transporting unit and the image forming operation of the image forming unit according to a result of detection by the position detection unit.

19. An image forming apparatus comprising:

an image carrier belt shaped like an endless belt;

an image forming unit that forms an image on the image carrier belt;

a transfer unit that transfers the image formed on the image carrier belt by the image forming unit onto paper;

a transporting unit that transports the paper toward the transfer unit;

an estimation unit that estimates a change in a circumferential length of the image carrier belt; and a controller unit that controls at least one of the paper transporting operation of the transporting unit and the image forming operation of the image forming unit according to a result of estimation by the estimation unit.

20. The image forming apparatus according to claim 19, further comprising:

a temperature detection unit that detects a temperature in the image forming apparatus, wherein the estimation unit estimates the change in the circumferential length of the image carrier belt according to a result of temperature detection by the temperature detection unit.

21. The image forming apparatus according to claim 19, further comprising:

a humidity detection unit that detects a humidity in the image forming apparatus, wherein the estimation unit estimates the change in the circumferential length of the image carrier belt according to a result of humidity detection by the humidity detection unit.

* * * * *